US011231243B2

(12) United States Patent
Ellis

(10) Patent No.: US 11,231,243 B2
(45) Date of Patent: Jan. 25, 2022

(54) RECOIL SPRING ASSEMBLY FOR A FIREARM, FIREARM, AND METHOD

(71) Applicant: Jameson S. Ellis, Sag Harbor, NY (US)

(72) Inventor: Jameson S. Ellis, Sag Harbor, NY (US)

( * ) Notice: Subject to any disclaimer, the term of this patent is extended or adjusted under 35 U.S.C. 154(b) by 3 days.

(21) Appl. No.: 16/798,693

(22) Filed: Feb. 24, 2020

(65) Prior Publication Data

US 2021/0262746 A1 Aug. 26, 2021

(51) Int. Cl.
*F41A 3/86* (2006.01)
*F41A 3/82* (2006.01)

(52) U.S. Cl.
CPC . *F41A 3/86* (2013.01); *F41A 3/82* (2013.01)

(58) Field of Classification Search
CPC ..... F41A 3/78; F41A 3/80; F41A 3/82; F41A 3/86; F41A 3/90; F41A 3/92; F41A 3/94
See application file for complete search history.

(56) References Cited

U.S. PATENT DOCUMENTS

| | | | | |
|---|---|---|---|---|
| 580,926 | A * | 4/1897 | Browning | F41A 3/86 89/196 |
| 621,747 | A * | 3/1899 | Browning | F41A 3/86 89/196 |
| 4,915,011 | A | 4/1990 | Smith | |
| 5,216,191 | A | 6/1993 | Fox | |
| 5,734,120 | A | 3/1998 | Besselink | |
| 6,993,864 | B1 | 2/2006 | O'Clair et al. | |
| 7,103,998 | B2 * | 9/2006 | McGarry | F41A 3/86 42/16 |
| 8,887,617 | B2 | 11/2014 | Pflaumer et al. | |
| 8,939,059 | B2 | 1/2015 | Coffman, II | |
| 9,777,980 | B2 * | 10/2017 | Heizer | F41A 19/10 |
| 10,203,173 | B2 | 2/2019 | Ellis et al. | |
| 2007/0012170 | A1 | 1/2007 | Spielberger | |
| 2013/0099433 | A1 | 4/2013 | Wodrich | |
| 2015/0316336 | A1 | 11/2015 | Lee | |

FOREIGN PATENT DOCUMENTS

| | | | | |
|---|---|---|---|---|
| CA | 3 025 163 | | 12/2017 | |
| FR | 836650 | A * | 1/1939 | F41A 3/86 |
| GB | 191210566 | A * | 8/1912 | F41A 3/82 |
| GB | 134777 | A * | 11/1919 | F41A 19/34 |

OTHER PUBLICATIONS

Laugo Arms: "Alien 500," Laugo Arms Czechoslovakia (2019).
"Small Arms of the World," by W.H.B. Smith, revised by Joseph E. Smith, 'Browning High Power,' (Oct. 3, 1975).
YouTube video: "First look at ALIEN pistol from Laugo Arms," https://www.youtube.com/watch?v=NnOfkm1bAE (Oct. 2, 2018).
YouTube video: "How a Dreyse M1907 works," https://www.youtube.com/watch?v=Lm6vbF4DpoA (Jan. 17, 2017).
"Frommer Stop" https://www.artstation.com/artwork/xXGGO.
Ed Buffaloe: "The 1899/1900 FN Browning," https://unblinkingeye.com/Guns/1900FNB/FNB002fnb002.html.

* cited by examiner

*Primary Examiner* — Joshua T Semick
(74) *Attorney, Agent, or Firm* — Walters & Wasylyna LLC

(57) ABSTRACT

A firearm includes a frame, a barrel, a slide, and a recoil spring assembly. The barrel is coupled to the frame. The slide is coupled to the frame and is movable relative to the frame along a recoil axis. The recoil spring assembly is coupled to the frame and to the slide. The recoil spring assembly is retained within the slide and is situated between the barrel and the slide. The recoil spring assembly biases the slide to a fully forward position relative to the frame. The recoil spring assembly transfers a recoil force from the slide to the frame.

20 Claims, 12 Drawing Sheets

RECOIL SPRING ASSEMBLY FOR A FIREARM, FIREARM, AND METHOD

FIELD

The present disclosure is generally related to firearms and, more particularly, to recoil spring assemblies for semiautomatic firearms, such as semiautomatic pistols, and methods of making and operating the same.

BACKGROUND

Recoil springs are an essential component for operation of semiautomatic firearms, such as semiautomatic pistols. For example, most autoloading firearms, such as blowback operated firearms, short recoil operated firearms and gas-operated firearms, depend on a recoil spring to function. When a bullet is fired, the act of firing produces a force that propels the action (e.g., a bolt or a slide) to the rear, ejecting the spent case and compressing the recoil spring. The recoil spring then decompresses, sending the action forward, loading the next cartridge, and returning the firearm to a battery position to be fired again. Accordingly, those skilled in the art continue with research and development efforts directed to improvements in the operation of semiautomatic firearms and, particularly, to recoil springs for semiautomatic firearms.

SUMMARY

Disclosed is a firearm. In an example, the firearm includes a frame, a barrel, a slide, and a recoil spring assembly. The barrel is coupled to the frame. The slide is coupled to the frame and is movable relative to the frame along a recoil axis. The recoil spring assembly is coupled to the frame and to the slide. The recoil spring assembly is retained within the slide and is situated above the barrel. The recoil spring assembly biases the slide to a fully forward position relative to the frame. The recoil spring assembly transfers a recoil force from the slide to the frame.

Also disclosed is a recoil spring for a firearm. The firearm includes a frame, a slide, a barrel. The recoil spring assembly is configured to be retained within the slide. In one example, the recoil spring includes a rear spring guide configured to be situated above the barrel. The recoil spring assembly includes a front spring guide configured to be situated above the barrel. The recoil spring assembly includes at least one recoil spring situated between the front spring guide and the rear spring guide. The front spring guide and the rear spring guide are movable relative to each other along a recoil axis. The at least one recoil spring is configured to bias is configured to bias the front spring guide and the rear spring guide away from each other.

Also disclosed is a method. In one example, the method includes steps of: (1) situating a recoil spring assembly between a barrel of a firearm and a slide of the firearm; (2) coupling the recoil spring assembly to a frame of the firearm and to the slide; (3) biasing the slide to a fully forward position relative to the frame. The recoil spring assembly is configured to transfer a recoil force from the slide to the frame.

Other examples of the disclosed recoil spring, firearm and method will become apparent from the following detailed description, the accompanying drawings and the appended claims.

DETAILED DESCRIPTION

Figure 1:
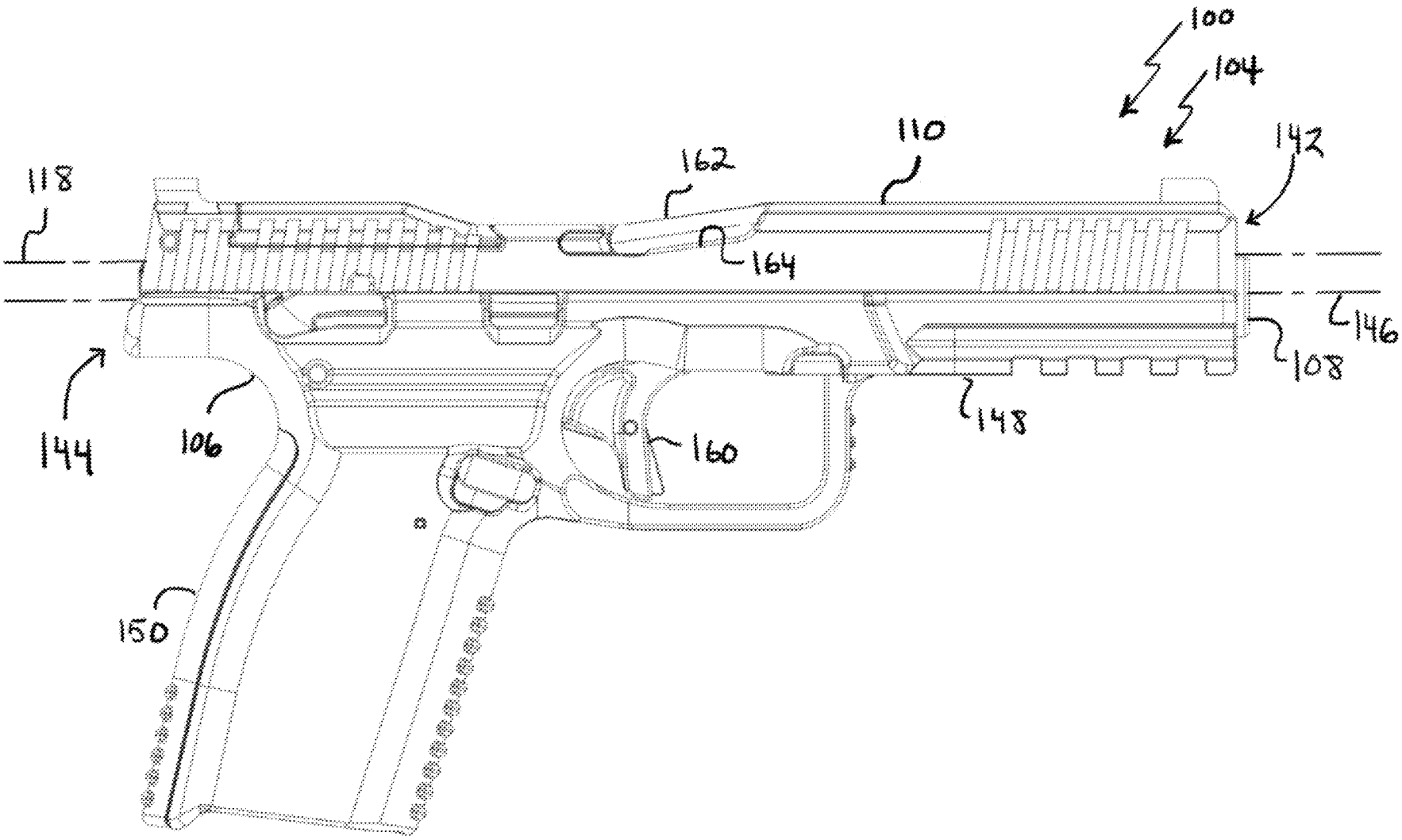
FIG. 1 is a schematic side elevation view of an example of a firearm.

The following detailed description refers to the accompanying drawings, which illustrate specific examples described by the present disclosure. Other examples having different structures and operations do not depart from the scope of the present disclosure. Like reference numerals may refer to the same feature, element or component in the different drawings.

Illustrative, non-exhaustive examples, which may be, but are not necessarily, claimed, of the subject matter according the present disclosure are provided below. Reference herein to "example" means that one or more feature, structure, element, component, characteristic, and/or operational step described in connection with the example is included in at least one aspect, embodiment, and/or implementation of the subject matter according to the present disclosure. The subject matter characterizing any one example may, but does not necessarily, include the subject matter characterizing any other example. Moreover, the subject matter characterizing any one example may be, but is not necessarily, combined with the subject matter characterizing any other example.

The present disclosure recognizes that recoil forces from a bullet being fired and propellant gases exiting a muzzle of a barrel of a firearm act directly down a centerline of the barrel, which creates a rotational force. Conventional semiautomatic pistol design situates a recoil spring under the barrel, between the barrel and a frame of the firearm, thus raising the position of the barrel relative to the frame and raising the centerline relative to a grip of the firearm. The higher the centerline of the barrel is above a center of contact between a shooter and the grip, the greater the rotational force that causes the firearm to rotate and the muzzle end to rise upward, commonly referred to as muzzle rise, muzzle flip or muzzle climb.

Referring to FIGS. 1-17, by way of examples, the present disclosure is directed to a firearm 100. By way of examples, the present disclosure is also directed to a recoil spring assembly 102 for the firearm 100. The firearm 100 and, particularly, the configuration of the recoil spring assembly 102, advantageously lowers a firing axis of the firearm 100 to reduce muzzle rise during a firing cycle.

Figure 2:
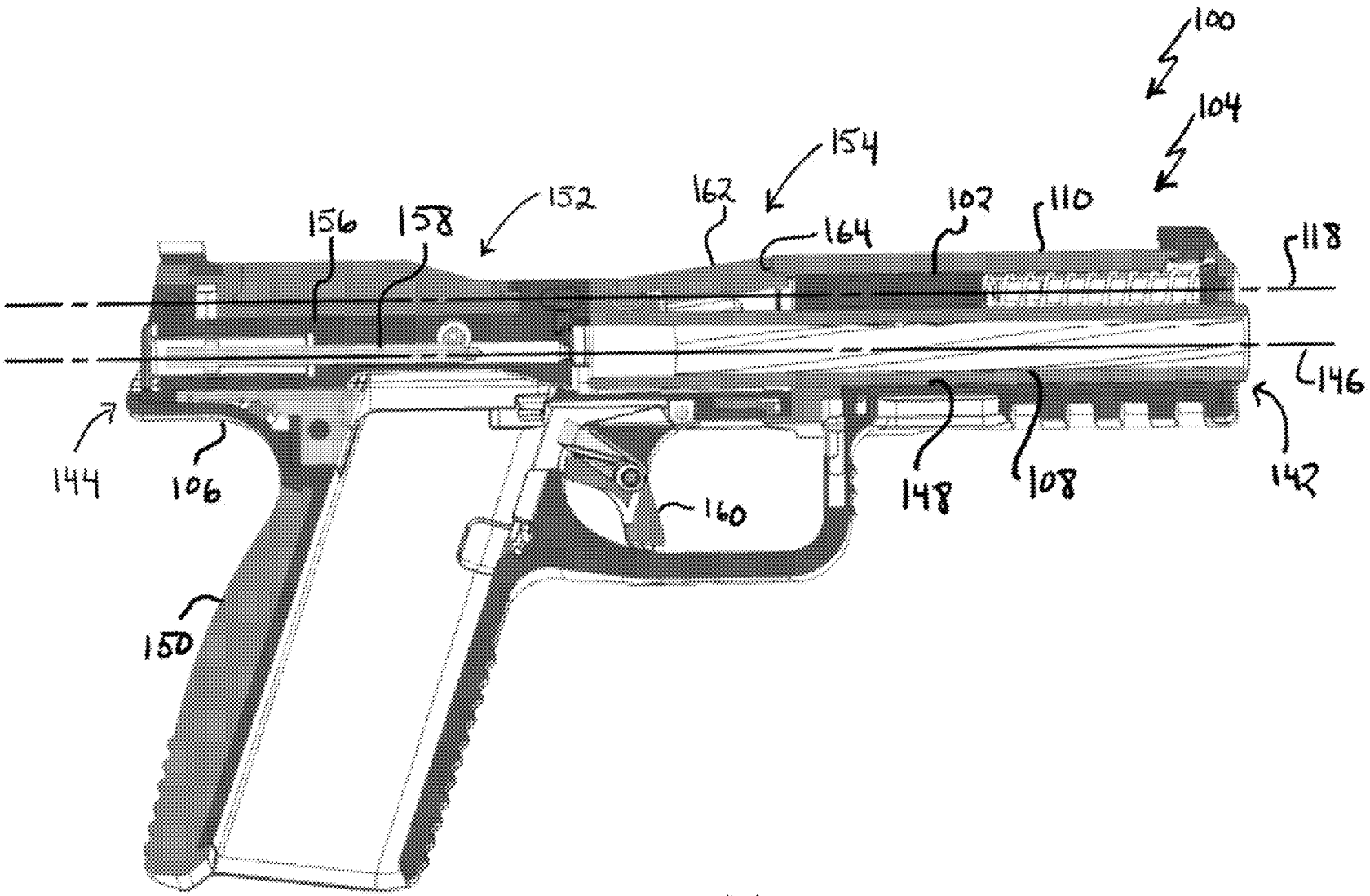
FIG. 2 is a schematic side elevation, sectional view of an example of the firearm.
Figure 3:
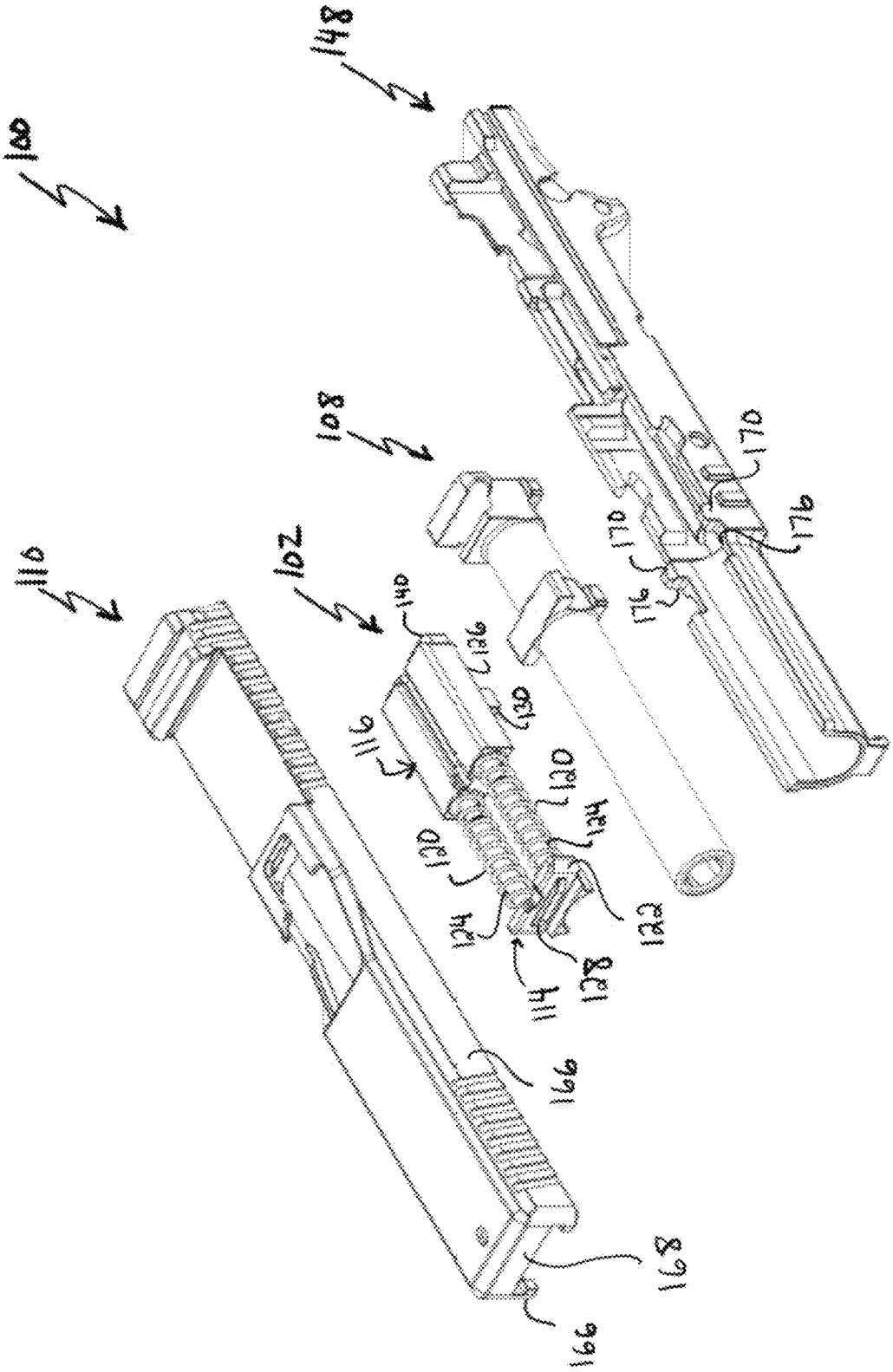
FIG. 3 is a schematic perspective, exploded view of an example of a portion of the firearm.
Figure 16:
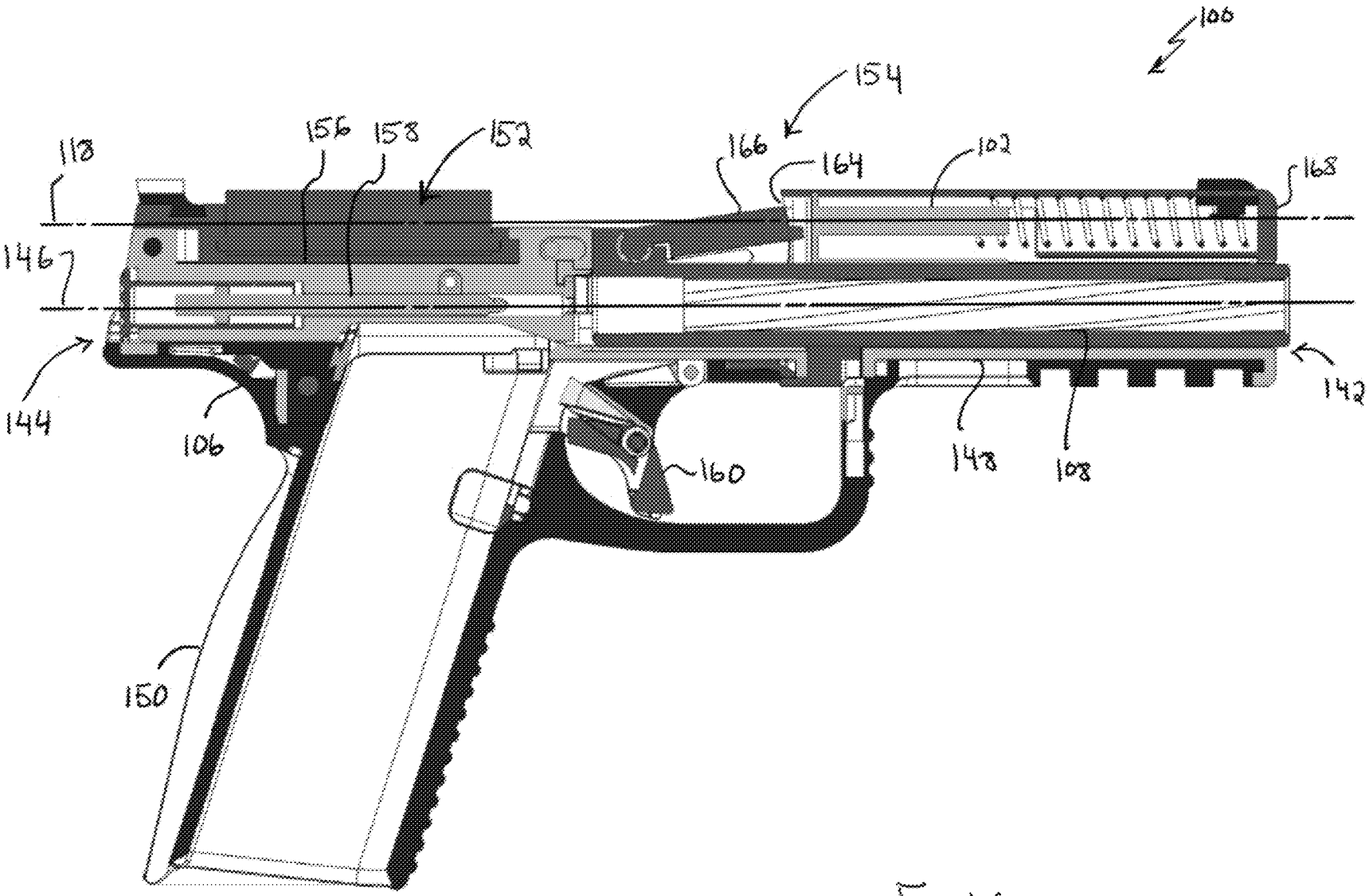
FIG. 16 is a schematic side elevation, sectional view of an example of the firearm.

Referring to FIGS. 1-3, 16 and 17, the firearm 100 may include any one of various types of the locked-breech, autoloading pistols. Throughout the present disclosure, examples of the firearm 100 may be shown and described as a short recoil semiautomatic pistol 104 (FIGS. 1, 2 and 16). The firearm 100 includes a front end 142 (e.g., muzzle end) and a rear end 144 (e.g., butt end). The rear end 144 is longitudinally opposed to the front end 142. The firearm 100 includes a frame 106, a barrel 108, a slide 110, and the recoil spring assembly 102 (FIGS. 2, 3 and 16). The recoil spring assembly 102 is retained within the slide 110 and is situated above the barrel 108, between the barrel 108 and the slide 110.

For the purpose of the present disclosure, the terms "front" and "forward" refer to a direction oriented toward an exit end of the barrel 108 and the terms "rear" and "rearward" denotes a direction oriented away from the exit end of the barrel 108.

Figure 17:
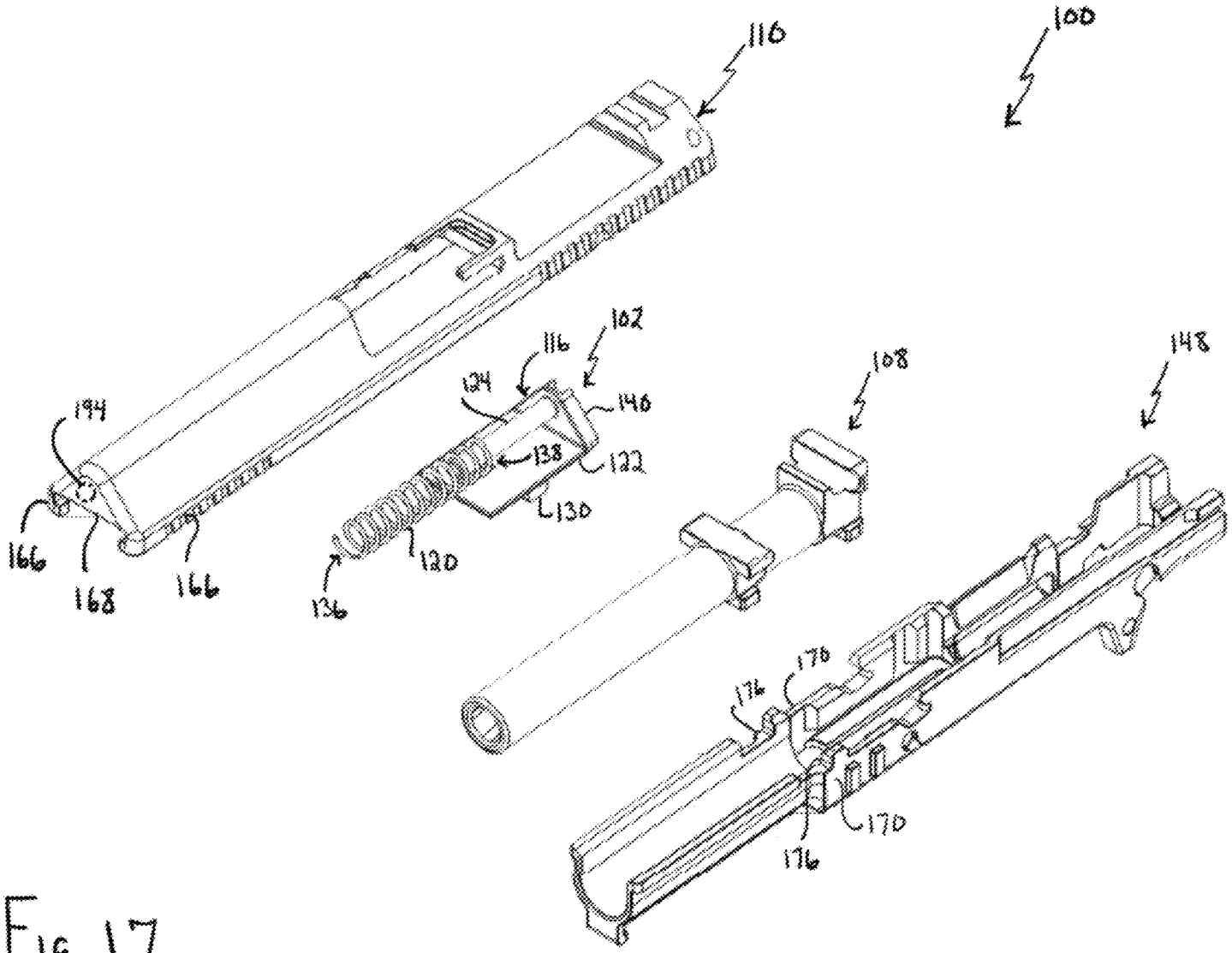
FIG. 17 is a schematic perspective, exploded view of an example of a portion of the firearm.
Figure 18:
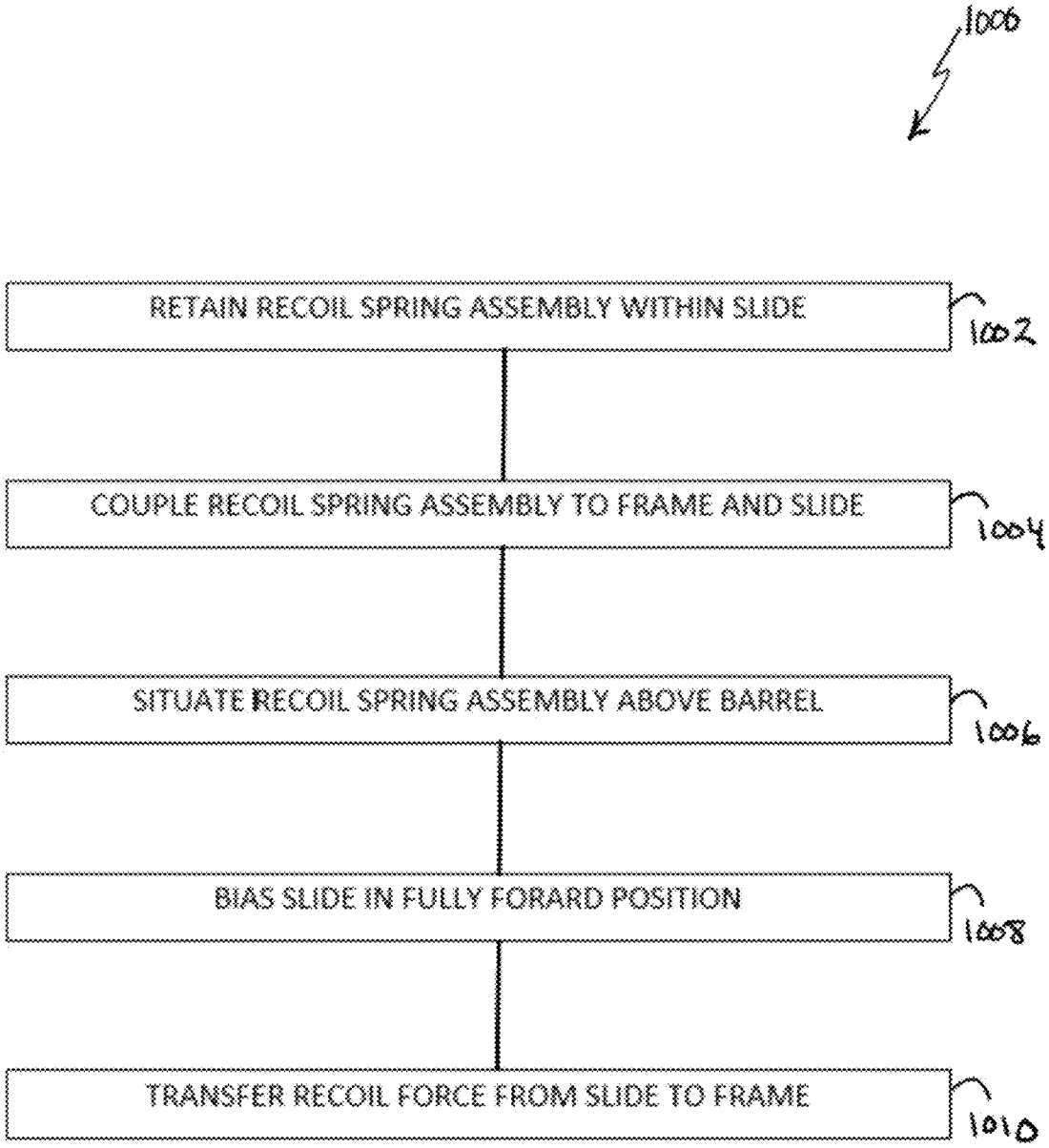
FIG. 18 is a flow diagram of a method of making or operating a firearm.

The barrel 108 is coupled to the frame 106. The slide 110 is coupled to the frame 106. The slide 110 is movable relative to the frame 106 along a recoil axis 118. In one or more examples, the frame 106 includes a receiver 148 and a grip 150. FIGS. 3 and 17 depict the receiver 148, the barrel 108, the recoil spring assembly 102, and the slide 110 of the firearm 100.

The frame 106 (e.g., the receiver 148 and the grip 150) may be a unitary structure or may be separate structures that are coupled together. FIGS. 3 and 17 illustrates examples of a portion of the firearm 100 in which the receiver 148 is a separate component of the frame 106, such as being removable from the grip 150 (not shown in FIGS. 3 and 17).

The grip 150 enables the shooter to firmly grasp and hold the firearm 100 and forms the center of contact between the shooter and the frame 106. The grip 150 also forms an internal chamber into which a magazine (not shown) is slidably received. The magazine may be of a conventional design in which cartridges (not shown) in a parallel, longitudinal stacked relation are biased toward a top having its front and back cut in relief to allow the cartridge to slide longitudinally out from the top.

In one or more examples, the slide 110 is coupled to the receiver 148. The slide 110 is movable relative the receiver 148 along the recoil axis 118. For example, the slide 110 moves longitudinally rearward and forward (e.g., reciprocal motion) relative to the frame 106, such as to the receiver 148, and to the barrel 108 along the recoil axis 118 during the firing cycle.

The frame 106 (e.g., the receiver 148 and/or the grip 150) and the slide 110 may be fabricated from metal, a polymer, or a combination thereof.

During the firing cycle, the slide 110 moves along the frame 106 between a fully forward position and a fully rearward position to perform operational actions resulting from firing of a chambered cartridge (not shown). The frame 106, such as the receiver 148, may also include a slide stop. The slide stop is configured to limit rearward travel of the slide 110 relative to the frame 106.

In one or more examples, the barrel 108 is coupled to the receiver 148. The barrel 108 may be removable from the frame 106, such as removable from the receiver 148. The barrel 108 is situated between the frame 106 and the slide 110. For example, the barrel 108 is situated between the receiver 148 and the slide 110. As best illustrated in FIGS. 2 and 16, a lower portion of the barrel 108 may be situated within (e.g., is received by) the receiver 148 and an upper portion of the barrel 108 may be situated within (e.g., is received by) the slide 110. As used herein, the term "situated" may refer to an item being located, positioned, or disposed relative to another item.

A centerline 146 of the barrel 108 may also be referred to as a bore axis. The centerline 146 of the barrel 108 forms the firing axis of the firearm 100. In one or more examples, the centerline 146 of the barrel 108 and the recoil axis 118 may be parallel to each other.

The barrel 108 may be movable relative to the frame 106, such as relative to the receiver 148. For example, the barrel 108 may move longitudinally rearward and forward (e.g., reciprocal motion) relative to the frame 106 during the firing cycle. Alternatively, the barrel 108 may be fixed to the frame 106, such as to the receiver 148, and remain stationary relative to the frame 106 during the firing cycle.

As best illustrated in FIGS. 2 and 16, the firearm 100 also includes various other operational components common to the semiautomatic pistol 104, such as, but not limited to, a firing mechanism 152. The firing mechanism 152 operates to fire the chambered cartridge. The firing mechanism 152 may be situated in (e.g., housed by) the frame 106, such as the receiver 148, and/or the slide 110. The firing mechanism 152 may include a breechblock 156, a striker 158 (e.g., a firing pin), and a trigger 160. The firing mechanism 152 may also include various other components, such as, but not limited to, an extractor or ejector, a sear, and a safety.

Figure 4:
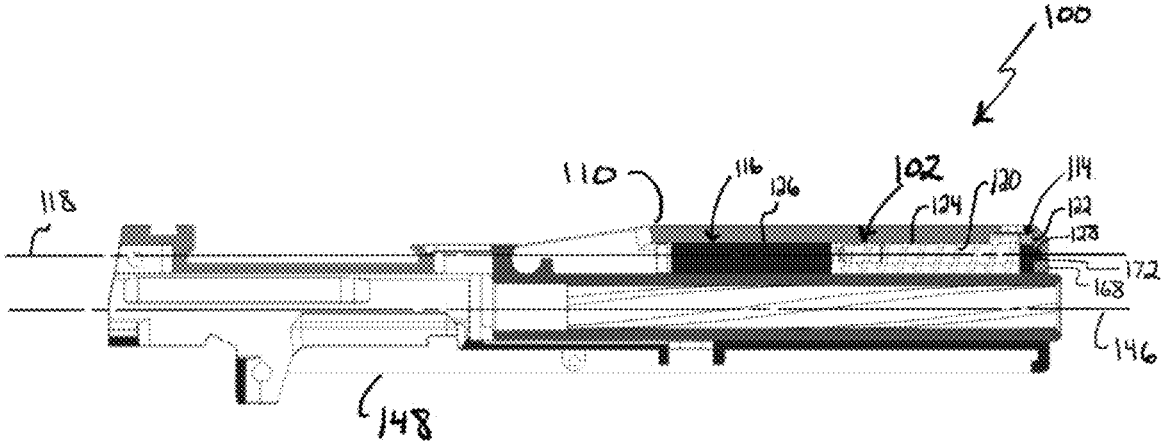
FIG. 4 is a schematic side elevation, sectional view of an example of a portion of the firearm in a battery position.
Figure 5:
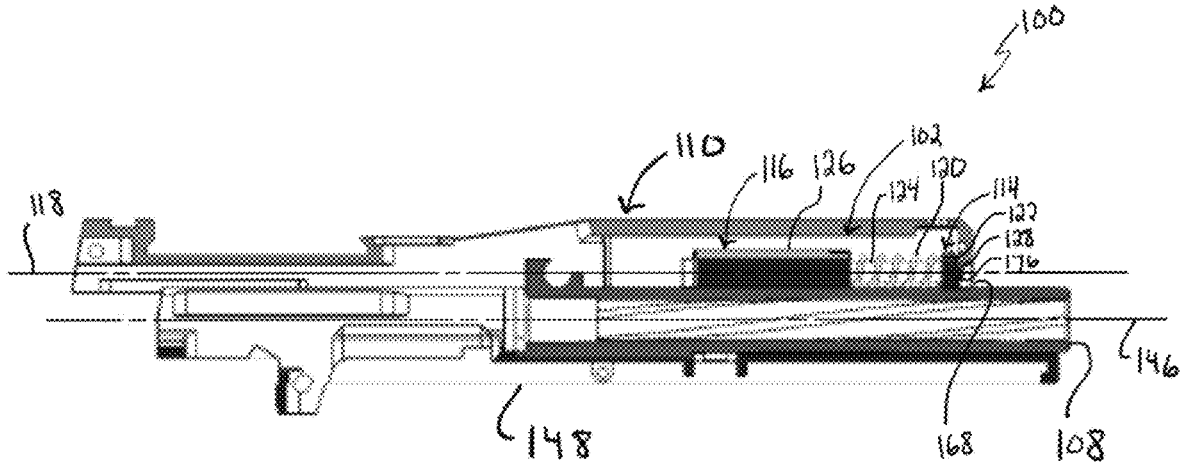
FIG. 5 is a schematic side elevation, sectional view of an example of a portion of the firearm in a recoil position.

FIGS. 4 and 5, in combination, schematically illustrate portions of the firing cycle of an example of a portion of the firearm 100. For clarity of illustration, FIGS. 4 and 5 depict the receiver 148, the barrel 108, the recoil spring assembly 102, and the slide 110. FIG. 4 illustrates an example of the portion of the firearm 100 in a battery position. FIG. 5 illustrates an example of the portion of the firearm 100 in a recoil position. Generally, the battery position refers to a condition of the firearm 100 in which the slide 110 fully forward and the firearm 100 is in a ready-to-fire state. Generally, the recoil position refers to a condition of the firearm 100 in which the slide 110 is fully rearward.

The recoil spring assembly 102 is configured to be coupled to the slide 110. For example, with the firearm 100 in the partially assembled state, the recoil spring assembly 102 is coupled to and is retained (e.g., held) within the slide 110. For the purpose of the present disclosure, the "partially assembled state" of the firearm 100 refers to a condition of the firearm 100 in which the some of the components of the firearm 100 are assembled, such as with the recoil spring assembly 102 coupled to the slide 110 and the barrel 108 coupled to the frame 106, and in which some of the components of the firearm 100 are disassembled, such as with the slide 110 and recoil spring assembly 102 uncoupled from the frame 106.

The recoil spring assembly 102 being retained within the slide 110 in the partially assembled state enables the slide 110 and the recoil spring assembly 102, as a unit, to be coupled to the frame 106, such as to the receiver 148. For example, with the recoil spring assembly 102 coupled to and retained within the slide 110, the recoil spring assembly 102 is coupled to the frame 106 concurrent with and part of the same action as the slide 110 being coupled to the frame 106.

The recoil spring assembly 102 is configured to be coupled to the frame 106 and to the slide 110. For example, with the firearm 100 in an assembled state, the recoil spring assembly 102 is coupled to the frame 106 and to the slide 110 (e.g., FIGS. 1, 2, 4, 5 and 16). For the purpose of the present disclosure, the "assembled state" of the firearm 100 refers to a condition of the firearm 100 in which the components of the firearm 100 are assembled in an operational state, such as with the recoil spring assembly 102 coupled to the frame 106 and to the slide 110.

The recoil spring assembly 102 is configured to be situated above the barrel 108, such as between the barrel 108 and the slide 110 (e.g., FIGS. 3 and 17). For example, with the firearm 100 in the assembled state, the recoil spring assembly 102 is situated above the barrel 108, such as between the barrel 108 and the slide 110 (e.g., FIGS. 2, 4, 5 and 16).

Situating the recoil spring assembly 102 above the barrel 108 enables the barrel 108 to be situated at a lower position relative to the frame 106 and, thus, advantageously lowers the centerline 146 of the barrel 108 closer to the center of contact between the shooter and the grip 150 of the frame 106. Lowering the centerline 146 of the barrel 108 (e.g., lowering the firing axis of the firearm 100) reduces the amount of muzzle rise induced by the recoil force from the bullet being fired and the propellant gases exiting the muzzle of the barrel 108.

With the firearm 100 in the assembled state, the recoil spring assembly 102 biases the slide 110 in a bias direction along the recoil axis 118 to the fully forward position relative to the frame 106. In other words, the recoil spring assembly 102 biases the slide 110 to the battery position. With the slide 110 in the fully forward position (e.g., FIG. 4), the recoil spring assembly 102 is less than fully compressed.

During the firing cycle, the firearm 100 begins in the battery position (e.g., FIG. 4). In the battery position, the striker 158 (FIG. 2) is locked in a ready position by the sear. Pulling the trigger 160 (FIG. 2) causes movement of the sear to release the striker 158 and fire the chambered cartridge. When the cartridge is fired, the act of firing produces a force that propels the slide 110 to the rear. In other words, the resulting energy released from the fired cartridge causes the slide 110 to travel rearward. Rearward travel of the slide 110 relative to the frame 106 is generally referred to as recoil.

Recoil of the slide 110 ejects an empty cartridge case from an ejection port 164 formed in the slide 110. Recoil of the slide 110 compresses the recoil spring assembly 102 until kinetic energy imparted to the slide 110 is overcome by potential energy being imparted to the recoil spring assembly 102 as it is being compressed. The recoil spring assembly 102 is configured to transfer a recoil force (recoil momentum) from the slide 110 to the frame 106. The recoil force is then transferred to the ground through the body of the shooter.

With the slide 110 in the fully rearward position, the recoil spring assembly 102 is fully compressed (e.g., FIG. 5). As the recoil spring assembly 102 decompresses, the slide 110 is sent forward. In other words, at an end of rearward travel of the slide 110 (e.g., the fully rearward position), the slide 110 moves forward by reaction to a spring force provided by the recoil spring assembly 102.

Forward travel of the slide 110 loads a new cartridge into the chamber of the barrel 108. Forward travel of the slide 110 returns the firearm 100 to the battery position (e.g., FIG. 4). Returned to the battery position, the firearm 100 is ready to fire again.

Referring to FIGS. 2 and 16, in one or more examples of the firearm 100, such as the illustrated short recoil semiautomatic pistol 104, in which the barrel 108 moves relative to the frame 106 and relative to the slide 110 during the firing cycle, the firearm 100 may also include a barrel-locking mechanism 154. In these examples, the barrel-locking mechanism 154 is configured to and operates to selectively fix the barrel 108 during certain portions of the firing cycle. In other words, the barrel 108 and the slide 110 are selectively and releasably coupled to each other via the barrel-locking mechanism 154.

With the slide 110 in a fully forward position, the barrel-locking mechanism 154 is configured to engage the barrel 108 and to engage the slide 110 such that the barrel 108 is selectively locked to the slide 110. Upon firing, the slide 110 and the barrel 108 move rearward (e.g., recoil) a short distance while locked together. Near an end of rearward travel of the barrel 108, the barrel-locking mechanism 154 selectively disengages the slide 110 to unlock the barrel 108 from the slide 110. At the end of rearward travel of the barrel 108, the barrel 108 stops its rearward movement, but the unlocked slide 110 continues to move rearward. At the end of forward travel of the slide 110, both the slide 110 and the barrel 108 return to the fully forward position with the barrel-locking mechanism 154 engaged with both the barrel 108 and the slide 110 to lock the barrel 108 and the slide 110 together.

The barrel-locking mechanism 154 may be situated above the barrel 108, between the barrel 108 and the slide 110. For example, with the slide 110 in a fully forward position, the barrel-locking mechanism 154 may selectively engage the slide 110 to lock the barrel 108 and the slide 110 together. Situating the barrel-locking mechanism 154 above the barrel 108 enables the barrel 108 to sit lower relative to the frame 106 and, thus, advantageously lowers the centerline 146 of the barrel 108 (the firing axis) closer to the center of contact between the shooter and the grip 150 of the frame 106 to reduce the amount of muzzle rise.

The barrel-locking mechanism 154 may include a locking block 162 situated above the barrel 108. For example, the locking block 162 may be situated between the barrel 108 and the slide 110. In other words, the barrel 108 and the slide 110 are selectively interconnected via the locking block 162, situated between the barrel 108 and the slide 110.

With the slide 110 in a fully forward position, the barrel-locking mechanism 154 may selectively engage the ejection port 164 of the slide 110 to lock the barrel 108 and the slide 110 together. For example, with the slide 110 in a fully forward position, a portion of the locking block 162 extends through at least a portion of the ejection port 164 of the slide 110 to selectively engage the barrel 108 and the slide 110 and to selectively lock the barrel 108 and the slide 110 together. Near the end of rearward travel of the barrel 108, the locking block 162 is withdrawn from the ejection port 164 to selectively disengage the slide 110 and to selectively unlock the barrel 108 from the slide 110.

The position of the barrel-locking mechanism 154 relative to the barrel 108 and to the slide 110 may depend on various factors, such as, but not limited to, the type or model of the firearm 100 (e.g., the semiautomatic pistol 104), the location of the ejection port 164 relative to the slide 110, and other factors. Additionally, other positions of the barrel-locking mechanism 154 and/or other selective locking configurations of the barrel-locking mechanism 154 are also contemplated. For example, the barrel-locking mechanism 154 may be situated under the barrel 108, to the rear of the barrel 108, or at other locations relative to the barrel 108.

The illustrative examples of the firearm 100 and the recoil spring assembly 102 depict the firearm 100 that includes the barrel-locking mechanism 154 that is situated above the barrel 108, between the barrel 108 and the slide 110. However, implementations of the firearm 100 and recoil spring assembly 102 disclosed herein are equally applicable to other types of firearms, such as semiautomatic pistols that include a fixed barrel or a barrel-locking mechanism that is not above the barrel.

Referring now to FIGS. 6-15 and 17, the recoil spring assembly 102 includes a rear spring guide 116, a front spring guide 114, and at least one recoil spring 120. The rear spring guide 116, the front spring guide 114, and the at least one recoil spring 120 are configured to be situated above the barrel 108. The front spring guide 114 and the rear spring guide 116 are movable relative to each other along the recoil axis 118. The at least one recoil spring 120 is situated between the rear spring guide 116 and the front spring guide 114. The at least one recoil spring 120 is configured to bias the front spring guide 114 and the rear spring guide 116 away from each other, in the bias direction along the recoil axis 118.

As illustrated in FIGS. 2-15, in one or more examples, the front spring guide 114 and the rear spring guide 116 are coupled together. In these examples, the rear spring guide 116, the front spring guide 114, and the at least one recoil spring 120 are configured to be situated between the barrel 108 and the slide 110. The at least one recoil spring 120 is configured to bias the front spring guide 114 into coupling engagement with the slide 110. The at least one recoil spring 120 is configured to bias the rear spring guide 116 into coupling engagement with the frame 106, such as with the receiver 148.

Figure 6:
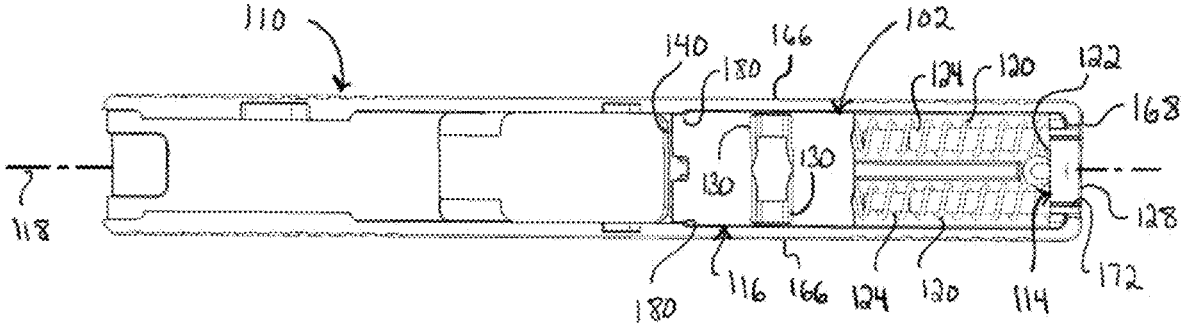
FIG. 6 is a schematic bottom plan view of an example of a slide and a recoil spring assembly of the firearm in the battery position.
Figure 7:
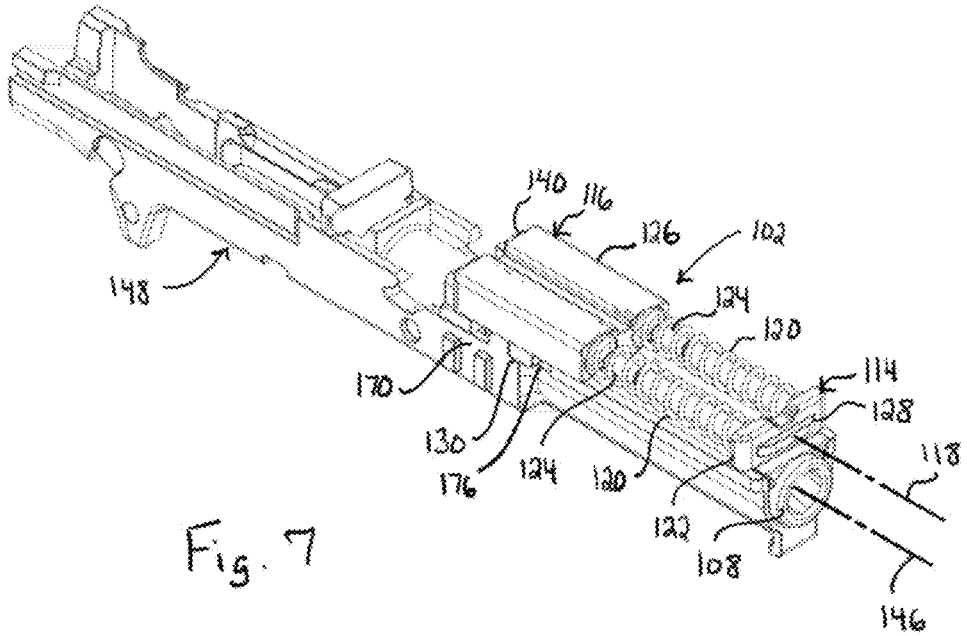
FIG. 7 is a schematic perspective view of an example of a receiver and the recoil spring assembly of the firearm in the battery position.
Figure 8:
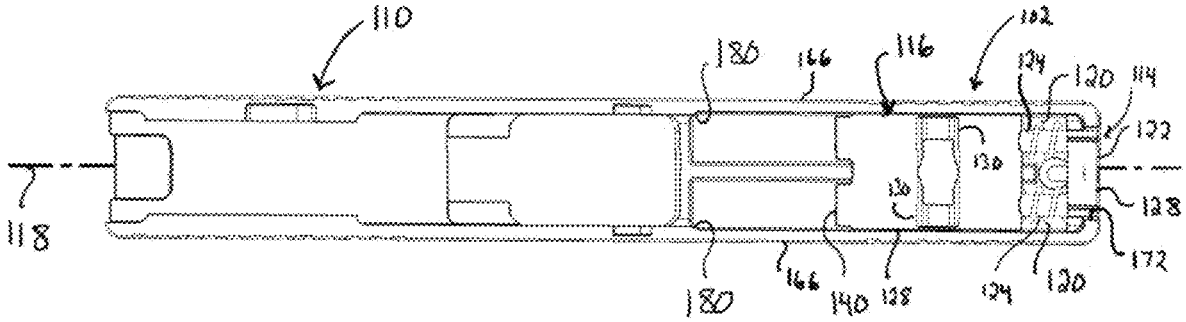
FIG. 8 is a schematic bottom plan view of an example of a slide and a recoil spring assembly of the firearm in the recoil position.
Figure 9:
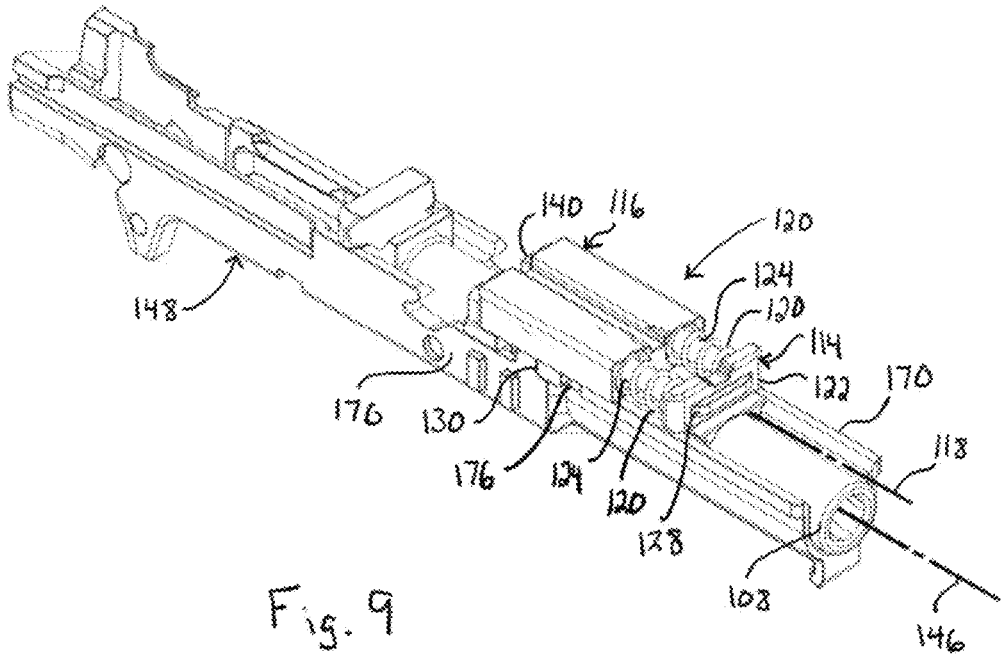
FIG. 9 is a schematic perspective view of an example of a receiver and the recoil spring assembly of the firearm in the recoil position.

FIGS. 6 and 8 schematically illustrate a position of an example of the recoil spring assembly 102 relative to the slide 110, for example, with the firearm 100 in assembled state. In other words, the frame 106 is not shown in FIGS. 6 and 8. FIGS. 7 and 9 schematically illustrate a position of an example of the recoil spring assembly 102 relative to the receiver 148 of the frame 106, for example, with the firearm 100 in the assembled state. In other words, the slide 110 is not shown in FIGS. 7 and 9. FIGS. 6 and 7 depict the recoil spring assembly 102 with the firearm 100 in the battery position (e.g., as illustrated in FIG. 4). FIGS. 8 and 9 depict the recoil spring assembly 102 with the firearm in the recoil position (e.g., as illustrated in FIG. 5). FIG. 6 is also a depiction of the configuration of an example of the recoil spring assembly 120 that is coupled to and retained within the slide 110, for example, with the firearm 100 in the partially assembly state.

With the firearm 100 in the assembled state, the at least one recoil spring 120 biases (e.g., is configured to bias) the rear spring guide 116 into coupling engagement with the frame 106, such as to the receiver 148, and biases (e.g., is configured to bias) the front spring guide 114 into coupling engagement with the slide 110. With the slide 110 in the fully forward position, the at least one recoil spring 120 is less than fully compressed (e.g., FIGS. 6 and 7). With the slide 110 in the fully rearward position, the at least one recoil spring 120 is fully compressed (e.g., FIGS. 8 and 9).

As illustrated in FIGS. 6 and 8, the recoil spring assembly 102 may be situated between opposing longitudinal slide-sidewalls 166 of the slide 110. In one or more examples, the rear spring guide 116 is in spring-biased engagement with the slide-sidewalls 166 and the front spring guide 114 is in spring-biased engagement with a slide-endwall 168 of the slide 110 via the at least one recoil spring 120. The slide-endwall 168 is located at the front end of the slide 110 and extends between slide-sidewalls 166 of the slide 110.

The rear spring guide 116 being in spring-biased engagement with the slide-sidewalls 166 of the slide 110 and the front spring guide 114 being in spring-biased engagement with the slide-endwall 168 of the slide 110 enables the recoil spring assembly 102 to be temporary coupled to the slide 110 during assembly of the firearm 100. Subsequent coupling of the slide 110 to the receiver 148 concurrently couples the rear spring guide 116 to the receiver 148. With the firearm 100 in the assembled state, the rear spring guide 116 is in spring-biased engagement with receiver-sidewalls 170 of the receiver 148 and the front spring guide 114 is in spring-biased engagement with the slide-endwall 168 of the slide 110 via the at least one recoil spring 120.

The front spring guide 114 may include at least one front lug 128 and the slide 110 includes at least one front-lug receptacle 172. For example, the slide-endwall 168 of the slide 110 may include the at least one front-lug receptacle 172. The front lug 128 is configured to engage the front-lug receptacle 172 to couple to the front spring guide 114 to the slide 110. The front lug 128 is biased into coupling engagement with the front-lug receptacle 172 via the at least one recoil spring 120.

Engagement of the front lug 128 with the front-lug receptacle 172 holds the front spring guide 114 in place when abutted with and biased against the slide-endwall 168 via the at least one recoil spring 120. Compression of at least one recoil spring 120 (e.g., the bias force applied to the front spring guide 114 by the at least one recoil spring 120 when compressed) may tend to urge the front spring guide 114 to shift position relative to the slide 110. Engagement of the front lug 128 with the front-lug receptacle 172 may maintain the front spring guide 114 in proper position relative to the slide 110 and in proper alignment with the recoil axis 118. For example, engagement of the front lug 128 with the front-lug receptacle 172 may prevent linear motion (e.g., in a direction perpendicular to the recoil axis 118) of the front spring guide 114 relative to the slide-endwall 168, may prevent rotational motion (e.g., about the recoil axis 118) of the front spring guide 114 relative to the slide-endwall 168, and may prevent pivotal motion (e.g., about an axis perpendicular to the recoil axis 118) of the front spring guide 114 relative to the slide-endwall 168.

The front lug 128 and the front-lug receptacle 172 may be complementary to each other in size and/or shape. For example, each one of the front lug 128 and the front-lug receptacle 172 may have any suitable dimension and/or shape such that at least a portion of the front lug 128 mates with or fits in the front-lug receptacle 172 in sufficiently close tolerance that the front lug 128 and the front-lug receptacle 172 are temporarily joined.

The front lug 128 may project from a front face of the front spring guide 114 in a forward direction (e.g., parallel to the recoil axis 118), such as toward the slide-endwall 168 with the firearm 100 in the assembled state. The front-lug receptacle 172 may depend from (e.g., be formed in) a rear face of the slide-endwall 168.

As illustrated, the front lug 128 may include, or take the form of, an elongated (e.g., long and thin) tab projecting from the front face of the front spring guide 114. The front-lug receptacle 172 may include, or take the form of, an elongated slot formed in the rear face of the slide-endwall 168 or an elongated aperture formed through the slide-endwall 168.

With the slide 110 removed from the receiver 148 and the recoil spring assembly 102 coupled to the slide 110, the front spring guide 114 is in spring-biased engagement with the slide 110 such that the front lug 128 is in complementary engagement with the front-lug receptacle 172. With the firearm 100 in the assembled state and the slide 110 in the fully forward position, the front spring guide 114 is in spring-biased engagement with the slide 110 such that the front lug 128 is in complementary engagement with the front-lug receptacle 172. During recoil (e.g., as the slide 110 travels rearward), the front spring guide 114 remains engaged with the slide 110 and travels rearward with the slide 110.

However, other structural configurations of the front lug 128 and the front-lug receptacle 172 are also contemplated to enable complementary engagement between the front lug 128 and the front-lug receptacle 172. For example, the front lug 128 may include, or take the form of, a plurality of pins projecting from the front face of the front spring guide 114 and the front-lug receptacle 172 may include, or take the form of, a plurality of recesses formed in the rear face of the slide-endwall 168 or a plurality of apertures formed through the slide-endwall 168.

The front spring guide 114 may include a flange 132. The flange 132 may project from a bottom face of the front spring guide 114, for example, in a downward direction (e.g., perpendicular to the recoil axis 118), such as toward the barrel 108 with the firearm 100 in the assembled state. The flange 132 may include a concave surface 134. The concave surface 134 is configured to accommodate the barrel 108. For example, the concave surface 134 of the flange 132 forms a semi-circular or inverted U-shaped opening that is complementary to and that receives an upper portion of the barrel 108 when the firearm 100 is in the assembled state.

With the firearm 100 in the assembled state, the concave surface 134 of the flange 132 may be in contact with a surface of the barrel 108 such that the front spring guide 114 slides along the barrel 108 during rearward and forward travel of the slide 110. Alternatively, with the firearm 100 in the assembled state, the concave surface 134 of the flange 132 may not in contact with the surface of the barrel 108 such that the front spring guide 114 is spaced from the barrel 108.

In one or more examples, the rear spring guide 116 at least one rear lug 130 and the receiver 148 includes at least one rear-lug receptacle 176. For example, the receiver-sidewalls 170 may include the at least one rear-lug receptacle 176. The rear lug 130 is configured to engage the rear-lug receptacle 176 to couple to the rear spring guide 116 to the receiver 148 of the frame 106. The rear lug 130 is biased into coupling engagement with the rear-lug receptacle 176 via the at least one recoil spring 120.

Engagement of the rear lug 130 with the rear-lug receptacle 176 holds the rear spring guide 116 in place when abutted with and biased against the receiver-sidewalls 170 of the receiver 148 via the at least one recoil spring 120. Compression of at least one recoil spring 120 (e.g., the bias force applied to the rear spring guide 116 by the at least one recoil spring 120 when compressed) may tend to urge the rear spring guide 116 to shift position relative to the receiver 148. Engagement of the rear lug 130 with the rear-lug receptacle 176 may maintain the rear spring guide 116 in proper position relative to the receiver 148 and in proper alignment with the recoil axis 118. For example, engagement of the rear lug 130 with the rear-lug receptacle 176 may prevent linear motion (e.g., in a direction perpendicular and/or parallel to the recoil axis 118) of the rear spring guide 116 relative to the receiver-sidewalls 170 and may prevent rotational motion (e.g., about the recoil axis 118) of the rear spring guide 116 relative to the receiver-sidewalls 170, and may prevent pivotal motion (e.g., about an axis perpendicular to the recoil axis 118) of the rear spring guide 116 relative to the receiver-sidewalls 170.

The rear lug 130 and the rear-lug receptacle 176 may be complementary to each other in size and/or shape. For example, each one of the rear lug 130 and the rear-lug receptacle 176 may have any suitable dimension and/or shape such that at least a portion of the rear lug 130 mates with or fits in the rear-lug receptacle 176 in sufficiently close tolerance that the rear lug 130 and the rear-lug receptacle 176 are temporarily joined.

The rear lug 130 may project from a bottom face of the rear spring guide 116, for example, in a downward direction (e.g., perpendicular to the recoil axis 118), such as toward the receiver-sidewalls 170 with the firearm 100 in the assembled state. The rear-lug receptacle 176 may depend from (e.g., be formed in) the receiver-sidewall 170.

In the illustrative examples, rear spring guide 116 includes two (e.g., a laterally opposed pair of) rear lugs 130 and the receiver 148 includes two (e.g., a laterally opposed pair of) rear-lug receptacles 176. For example, each one of the receiver-sidewalls 170 includes one of the pair of rear-lug receptables 176 that is associated with a respective one of the pair of rear lugs 130.

The rear-lug receptacles 176 may be situated on the receiver-sidewalls 170 such that the rear spring guide 116 is situated above the barrel 108, between a front end of the barrel 108 and a rear end of the barrel 108, with the firearm 100 in the assembled state. For example, the rear-lug receptacles 176 may be situated on the receiver-sidewalls 170 such that the rear spring guide 116 is situated forward of the barrel-locking mechanism 154 (FIG. 2) with the firearm 100 in the assembled state.

As illustrated, each one of the rear lugs 130 may include, or take the form of, a stud projecting from the bottom face of the rear spring guide 116. Each one of the rear-lug receptacles 176 may include, or take the form of, an indentation (e.g., a recess or notch) formed in a top surface of a respective receiver-sidewall 170.

However, other structural configurations of the rear lug 130 and the rear-lug receptacle 176 are also contemplated to enable complementary engagement between the rear lug 130 and the rear-lug receptacle 176.

The rear spring guide 116 may include a concave surface 178. The concave surface 178 extends between the pair of rear lugs 130 and is configured to accommodate the barrel 108. For example, the concave surface 178 of the rear spring guide 116 forms a semi-circular or inverted U-shaped opening that is complementary to and that receives an upper portion of the barrel 108 when the firearm 100 is in the assembled state.

With the firearm 100 in the assembled state, the concave surface 178 of the rear spring guide 116 may be in contact with a surface of the barrel 108 such that the rear spring guide 116 sits upon the barrel 108. Alternatively, with the firearm 100 in the assembled state, the concave surface 178 of the rear spring guide 116 may not in contact with the surface of the barrel 108 such that the rear spring guide 116 is spaced from the barrel 108.

The rear spring guide 116 may include a rear terminus 140 that is configured to be coupled to the slide 110, such as during assembly of the firearm 100. The slide 110 may include a guide stop 180. The rear terminus 140 is configured to engage the guide stop 180 to couple the rear spring guide 116 to the slide 110. The rear terminus 140 is biased into coupling engagement with the guide stop 180 via the at least one recoil spring 120.

Engagement of the rear terminus 140 with the guide stop 180 holds the rear spring guide 116 in place when abutted with and biased against the guide stop 180 via the at least one recoil spring 120. Compression of at least one recoil spring 120 (e.g., the bias force applied to the rear spring guide 116 by the at least one recoil spring 120 when compressed) may tend to urge the rear spring guide 116 to shift position relative to the slide 110. Engagement of the rear terminus 140 with the guide stop 180 may maintain the rear spring guide 116 in proper position relative to the slide 110 and in proper alignment with the recoil axis 118. For examples, engagement of the rear terminus 140 with the guide stop 180 may prevent linear motion (e.g., in a direction perpendicular to the recoil axis 118) of the rear spring guide 116 relative to the slide 110, may prevent rotational motion (e.g., about the recoil axis 118) of the rear spring guide 116 relative to the slide 110, and may prevent pivotal motion (e.g., about an axis perpendicular to the recoil axis 118) of the rear spring guide 116 relative to the slide 110.

The rear terminus 140 and the guide stop 180 may be complementary to each other in size and/or shape. For example, each one of the rear terminus 140 and the guide stop 180 may have any suitable dimension and/or shape such that at least a portion of the rear terminus 140 mates with or fits in the guide stop 180 in sufficiently close tolerance that the rear terminus 140 and the guide stop 180 are temporarily joined.

The rear terminus 140 may project from a rear face of the rear spring guide 116 in a rearward direction (e.g., parallel to the recoil axis 118), such as toward the guide stop 180 of the slide 110 with the firearm 100 in the assembled state. Alternatively, the rear terminus 140 may be formed by the rear face of the rear spring guide 116. In other words, the rear terminus 140 may form a rear end of the rear spring guide 116. The guide stop 180 may project from an inner face of the slide-sidewall 166.

Figure 11:
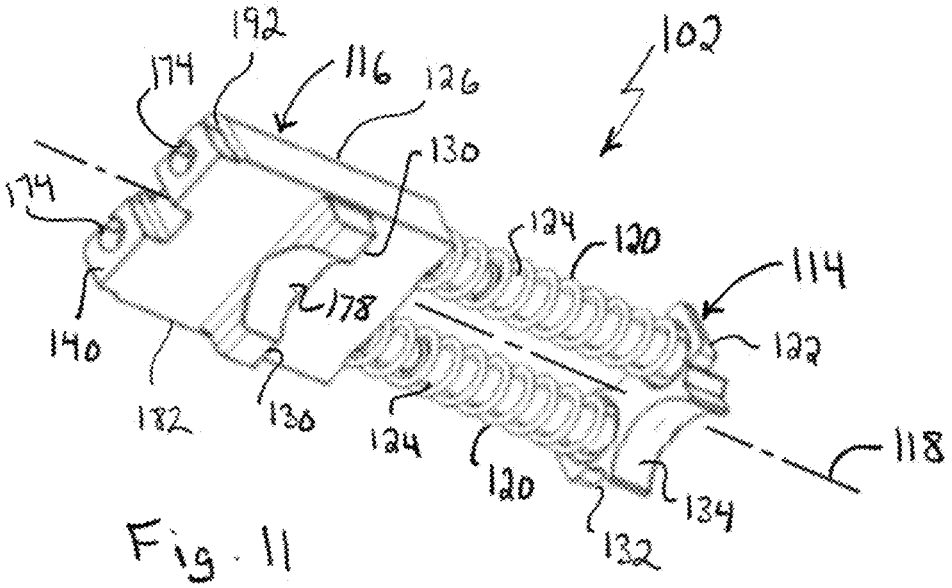
FIG. 11 is a schematic perspective, exploded view of an example of the recoil spring assembly.
Figure 12:
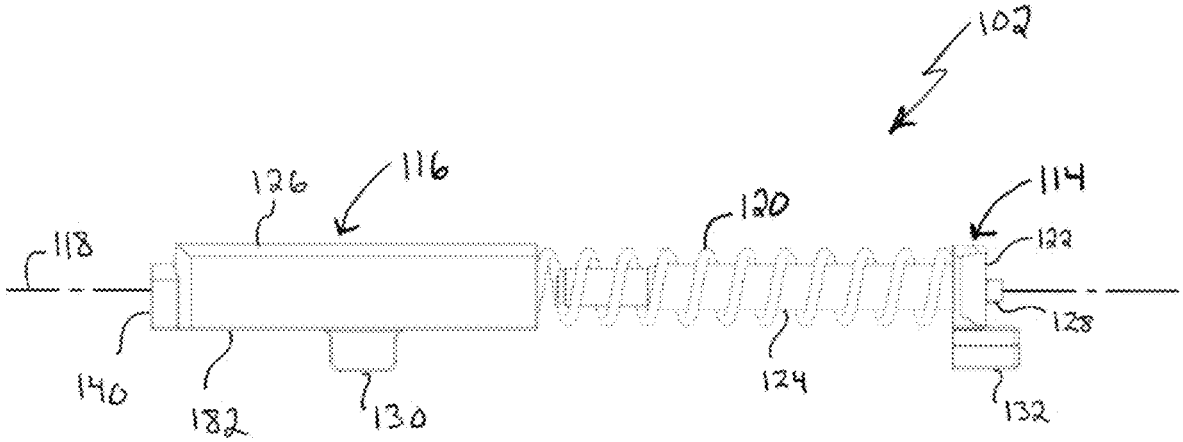

As best illustrated in FIG. 11, the rear terminus 140 of the rear spring guide 116 may have one or more dimensions (e.g., a cross-sectional dimension viewed along the recoil axis 118) that is less than one or more dimensions (e.g., a cross-sectional dimension viewed along the recoil axis 118) of a body 182 of the rear spring guide 116 such that a laterally opposed pair of shoulders 192 is formed between the body 182 and the rear terminus 140 on laterally opposed sides of the rear spring guide 116.

As best illustrated in FIGS. 6 and 8, the guide stop 180 may include, or take the form of, two (e.g., a laterally opposed pair of) margins (e.g., lips or protruding edges). Each margin projects from the inner face of an associated slide-sidewall 166 in an inward direction (e.g., perpendicular to the recoil axis 118).

With the slide 110 removed from the receiver 148 and the recoil spring assembly 102 coupled to the slide 110, the rear spring guide 116 is in spring-biased engagement with the slide 110 such that the rear terminus 140 is in complementary engagement with the guide stop 180. With the firearm 100 in the assembled state and the slide 110 in the fully forward position, the rear spring guide 116 is in spring-biased engagement with the receiver 148 such that the rear lugs 130 are in complementary engagement with the rear-lug receptacles 176. Optionally, with the firearm 100 in the assembled state and the slide 110 in the fully forward position, the rear spring guide 116 may remain in spring-biased engagement with the slide 110 such that the rear terminus 140 is in complementary engagement with the guide stop 180. During recoil (e.g., as the slide 110 travels rearward), the rear spring guide 116 disengages from the guide stop 180 but remains in spring-biased engagement with the receiver 148.

Referring now to FIGS. 10-15, one of the front spring guide 114 or the rear spring guide 116 may include a spring stop 122 and at least one spring rod 124. The at least one spring rod 124 is coupled to the spring stop 122. The at least one recoil spring 120 is situated on the at least one spring rod 124. The first spring-end 136 (FIG. 13) of the recoil spring 120 abuts the spring stop 122. The at least one spring rod 124 may include a first end that is coupled to the spring stop 122 and a second end that is opposite to the first end and the spring stop 122.

Figure 13:
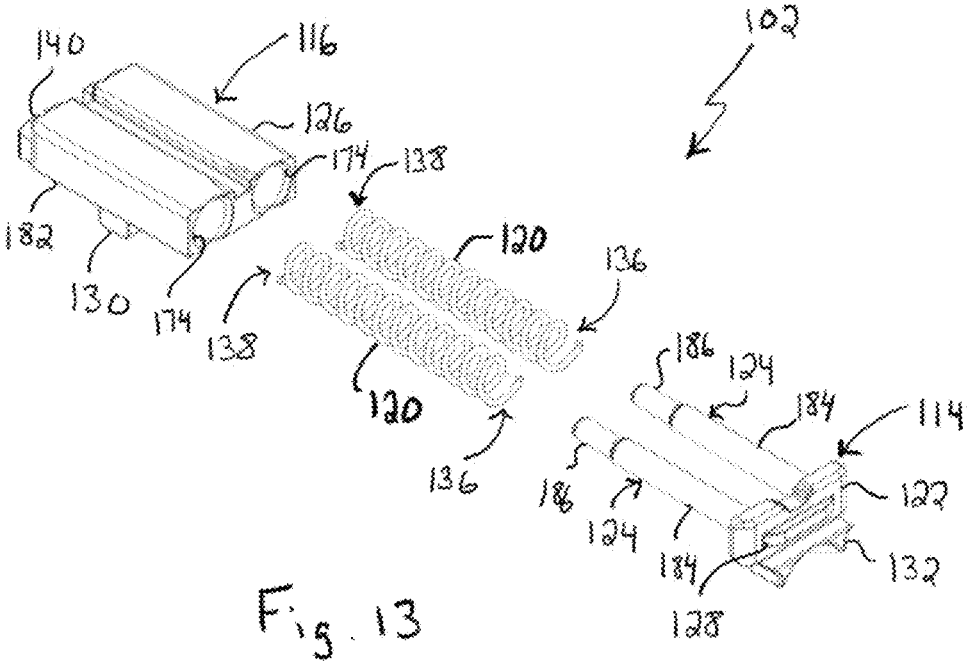
FIG. 13 is a schematic bottom perspective view of an example of the recoil spring assembly.

The other one of the front spring guide 114 or the rear spring guide 116 may include a spring housing 126. The at least one recoil spring 120 includes a second spring-end 138 (FIG. 13). The second spring-end 138 of the recoil spring 120 abuts the spring housing 126. The spring housing 126 may be configured to receive at least a portion of the at least one spring rod 124. The spring housing 126 may also be configured to receive at least a portion of the at least one recoil spring 120.

In the illustrative examples, the at least one recoil spring 120 may include, or take the form of, a spiral spring, a helical spring, or other suitable cylindrically shaped spring. The recoil spring 120 may be mounted on the spring rod 124 such that the spring rod 124 extends through a center of the recoil spring 120. In other words, the spring rod 124 is situated lengthwise within the recoil spring 120. However, various other types of springs may also be used as the recoil spring 120.

The front spring guide 114, the rear spring guide 116, and the at least one recoil spring 120 may be discrete components capable of being separated from each other (e.g., as illustrated in FIGS. 13 and 17).

The spring housing 126 may include at least one spring aperture 174 (e.g., FIGS. 10, 11, 13 and 14). The at least one spring aperture 174 may be configured to receive at least a portion of the at least one spring rod 124. For example, the spring aperture 174 may have an inner dimension that is suitably sized to receive an outer dimension of the spring rod 124. The at least one spring aperture 174 may also be configured to receive at least a portion of the at least one recoil spring 120. For example, the spring aperture 174 may have an inner dimension that is suitably sized to receive an outer dimension of the recoil spring 120.

The spring aperture 174 may extend through at least a portion of the spring housing 126. An entry opening of the at least one spring aperture 174 may be formed in a face of the spring housing 126, such as the face that opposes the spring stop 122. The entry opening of the spring aperture 174 may be formed in a front face of the spring housing 126, such as examples in which the rear spring guide 116 includes the spring housing 126 (e.g., FIGS. 2-14). The entry opening of the spring aperture 174 may be formed in a rear face of the spring housing 126, such as examples in which the front spring guide 114 includes the spring housing 126 (e.g., FIG. 15).

The at least one spring aperture 174 may extend through an entirety of the spring housing 126. An exit opening of the at least one spring aperture 174 may be formed in an opposing face of the spring housing 126, such as the face that opposes the entry opening (e.g., FIG. 11). The exit opening of the spring aperture 174 may be formed in a rear face of the spring housing 126, such as examples in which the rear spring guide 116 includes the spring housing 126 (e.g., FIGS. 2-14). The exit opening of the spring aperture 174 may be formed in a front face of the spring housing 126, such as examples in which the front spring guide 114 includes the spring housing 126 (e.g., FIG. 15).

The at least one spring aperture 174 may extend through the rear terminus 140 and the exit opening of the at least one spring aperture 174 may be formed in the rear terminus 140 (e.g., as illustrated in FIG. 11).

Figure 14:
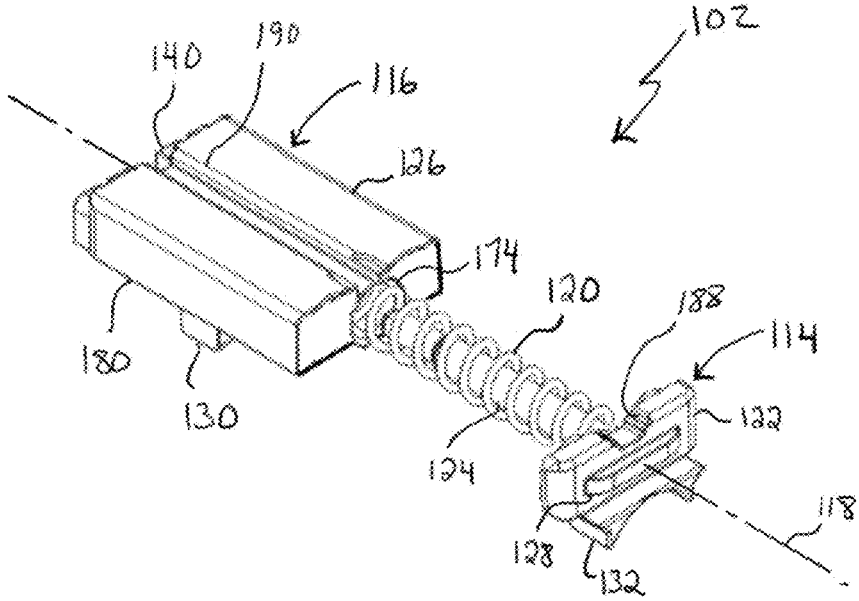
FIG. 14 is a schematic perspective view of an example of the recoil spring assembly.
Figure 15:
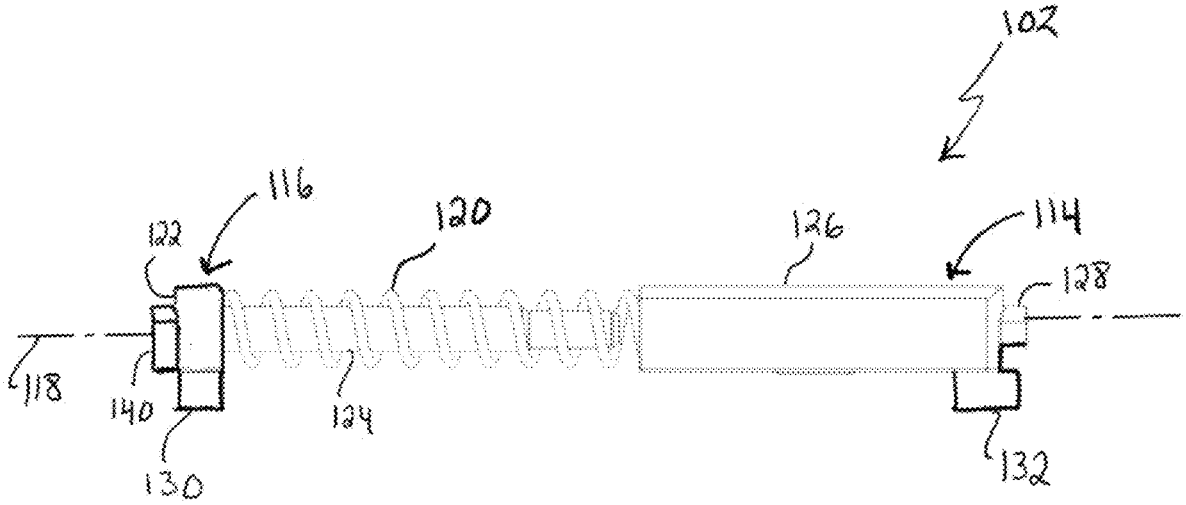
FIG. 15 is a schematic side elevation view of an example of the recoil spring assembly.

In one or more examples (e.g., as illustrated in FIGS. 2-14), the front spring guide 114 may include the spring stop 122 and the at least one spring rod 124 and the rear spring guide 116 may include the spring housing 126. However, this configuration may be reversed. In one or more examples (e.g., as illustrated in FIG. 15), the rear spring guide 116 may include the spring stop 122 and the at least one spring rod 124 and the front spring guide 114 may include the spring housing 126.

In one or more examples (e.g., as illustrated in FIGS. 3, 10, 11 and 13), the recoil spring assembly 102 includes two recoil springs 120. In these examples, the recoil spring assembly 102 may also include two associated spring rods 124 and spring apertures 174. However, in other configurations, a different number of recoil springs 120, and associated spring rods 124 and spring apertures 174, may be used. In one or more examples (e.g., as illustrated in FIG. 14), the recoil spring assembly 102 includes one recoil spring 120. In these examples, the recoil spring assembly 102 may include one associated spring rod 124 and spring aperture 174. In one or more examples, the recoil spring assembly 102 may include more than two recoil springs 120 and more than two associated spring rods 124 and spring apertures 174.

Use of a plurality of recoil springs 120 advantageously enables smaller springs to be used to generate the required recoil force needed for proper operation of the firearm 100 during the firing cycle. For example, a plurality of small recoil springs 120 may generate a recoil force equivalent to that generated by one large recoil spring 120. Reducing the size of the recoil spring 120 advantageously reduces the space between the barrel 108 and the slide 110 required to accommodate the recoil spring assembly 102.

As described above, with the firearm 100 in the assembled state and the slide 110 in the fully forward position, the recoil spring 120 is less than fully compressed and biases the rear spring guide 116 into coupling engagement with the receiver 148 and biases the front spring guide 114 into coupling engagement with the slide 110. Similarly, with the recoil spring assembly 102 coupled to the slide 110 and the slide 110 uncoupled from the receiver 148, the recoil spring 120 is less than fully compressed and biases the rear spring guide 116 and the front spring guide 114 into coupling engagement with the slide 110. These conditions may be referred to herein as a less than fully compressed state of the recoil spring assembly 102 or of the recoil spring 120.

In the less than fully compressed state, an end portion (e.g., a portion proximate the second end) of the spring rod 124 may be received by the spring aperture 174 and may extend through a portion of the spring housing 126. Alternatively, in the less than fully compressed state, the spring rod 124 may be spaced from the spring housing 126 and be situated outside of the spring aperture 174.

In the less than fully compressed state, the second spring-end 138 may be abutted against the spring housing 126 (e.g., the front face or the rear face of the spring housing 126). Alternatively, in the less than fully compressed state, an end portion (e.g., a portion proximate the second spring-end 138) of the recoil spring 120 may be received by the spring aperture 174 and may extend through a portion of the spring housing 126.

As described above, with the firearm 100 in the assembled state and the slide 110 in the fully rearward position, the recoil spring 120 is fully compressed and biases the rear spring guide 116 into coupling engagement with the receiver 148 and biases the front spring guide 114 into coupling engagement with the slide 110. This condition may be referred to herein as a fully compressed state of the recoil spring assembly 102 or of the recoil spring 120. The recoil spring assembly 102 and the recoil spring 120 are in a compressing state as the slide 110 and the front spring guide 114 travel reward from the fully forward position to the fully rearward position. The recoil spring assembly 102 and the recoil spring 120 are in a decompressing state as the slide 110 and the front spring guide 114 travel forward from the fully rearward position to the fully forward position.

In the compressing state, the spring rod 124 may be inserted through the spring housing 126 via the spring aperture 174. In the fully compressed state, a portion of the spring rod 124 may be received by the spring aperture 174 and may extend through at least a portion of the spring housing 126. In the decompressing state, the spring rod 124 may be withdrawn from the spring housing 126 via the spring aperture 174.

In the fully compressed state, the spring rod 124 may extend through an entirety of the spring housing 126. The end portion of the spring rod 124 may extend (e.g., protrude) through the exit opening of the spring aperture 174, such as examples in which the spring aperture 174 extends through the entirety of the spring housing 126.

As best illustrated in FIG. 13, a first rod-portion 184 of the spring rod 124 may have a first outer dimension (e.g., diameter) and a second rod-portion 186 of the spring rod 124 may have a second outer dimension (e.g., diameter) that is less than the first outer dimension of the first rod-portion 184. In the fully compressed state, at least a portion of the second rod-portion 186 may extend (e.g., protrude) through the exit opening of the spring aperture 174.

Figure 10:
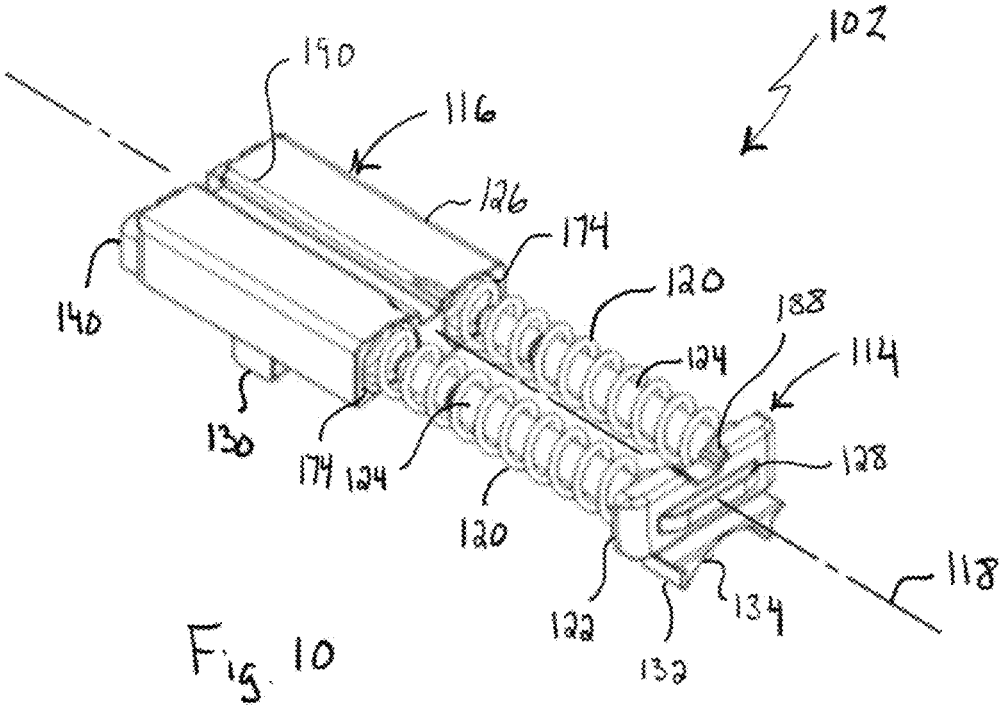
FIG. 10 is a schematic top perspective view of an example of the recoil spring assembly.

As best illustrated in FIGS. 10, 11 and 13, a first aperture-portion of the spring aperture 174 may have a first inner dimension (e.g., diameter), such as proximate to the entry opening of the spring aperture 174 (FIGS. 10 and 13). A second aperture-portion of the spring aperture 174 may have a second inner dimension (e.g., diameter), such as proximate to the exit opening of the spring aperture 174 (FIG. 11). The second inner dimension of the spring aperture 174 may be less than the first inner dimension of the spring aperture 174.

The second outer dimension of the second rod-portion 186 may be less than the second inner dimension of spring aperture 174 such that second rod-portion 186 extends through the exit aperture when the recoil spring assembly 102 is in the fully compressed state (e.g., when the slide 110 is in the fully rearward position).

The first inner dimension of the spring aperture 174 may be greater than the outer dimension (e.g., diameter) of the recoil spring 120 such that a portion of the recoil spring 120 is received by the spring aperture 174, via the entry opening, and extends partially through the spring housing 126 when the recoil spring assembly 102 is in the fully compressed state (e.g., when the slide 110 is in the fully rearward position). The second inner dimension of the spring aperture 174 may be less than the outer dimension of the recoil spring 120 such that the second spring-end 138 (FIG. 13) of the recoil spring 120 is prevented from protruding through the exit opening and the recoil spring 120 is retained within the spring aperture 174 during recoil. The second spring-end 138 may abut an inner shoulder of the spring housing 126 that is formed at a junction between the first portion of the spring aperture 174, having the first inner dimension, and the second portion of the spring aperture 174, having the second inner dimension when the recoil spring assembly 102 is in the fully compressed state (e.g., when the slide 110 is in the fully rearward position).

The recoil spring assembly 102 may also include various other structural features or elements depending on the type of firearm 100 with which the recoil spring assembly 102 is used. For example, the recoil spring assembly 102 may include notches, grooves, and the like that are configured to accommodate elements of the firearm 100 and enable relative motion of the slide 110.

As illustrated in FIGS. 10 and 14, the rear spring guide 116 may include at least one rear groove 190 formed in a top face. The rear groove 190 may accommodate a structural element situated on or projecting from an inner face of a top wall of the slide 110, such as a fastener for a rear sight. Similarly, the front spring guide 114 may include at least one front groove 188. The front groove 188 may accommodate a structural element situated on or projecting from the inner face of the top wall of the slide 110, such as a fastener for a front sight.

Referring to FIGS. 16 and 17, in one or more examples, the front spring guide 114 includes, or is formed by, the slide-endwall 168 of the slide 110. In these examples, the rear spring guide 116 and the at least one recoil spring 120 are configured to be situated between the barrel 108 and the slide 110. The at least one recoil spring 120 includes a first spring-end 136 that is configured to be biased into coupling engagement with the slide-endwall 168. The at least one recoil spring 120 is configured to bias the rear spring guide 116 into coupling engagement with the frame 106, such as with the receiver 148.

With the firearm 100 in the assembled state, the at least one recoil spring 120 biases (e.g., is configured to bias) the rear spring guide 116 into coupling engagement with the frame 106, such as to the receiver 148, and biases (e.g., is configured to bias) the first spring-end 136 into coupling engagement with the slide-endwall 168. With the slide 110 in the fully forward position, the at least one recoil spring 120 is less than fully compressed. With the slide 110 in the fully rearward position, the at least one recoil spring 120 is fully compressed.

The recoil spring assembly 102 may be situated between the slide-sidewalls 166 of the slide 110. In one or more examples, the rear spring guide 116 is in spring-biased engagement with the slide-sidewalls 166 and the first spring-end 136 is in spring-biased engagement with the slide-endwall 168 via the at least one recoil spring 120, such that the slide-endwall 168 serves as the front spring guide 114.

The rear spring guide 116 being in spring-biased engagement with the slide-sidewalls 166 of the slide 110 and the first spring-end 136 being in spring-biased engagement with the slide-endwall 168 of the slide 110 (the front spring guide 114) enables the recoil spring assembly 102 to be temporary coupled to the slide 110 during assembly of the firearm 100. Subsequent coupling of the slide 110 to the receiver 148 concurrently couples the rear spring guide 116 to the receiver 148. With the firearm 100 in the assembled state, the rear spring guide 116 is in spring-biased engagement with receiver-sidewalls 170 of the receiver 148 and the first spring-end 136 is in spring-biased engagement with the slide-endwall 168 of the slide 110 via the at least one recoil spring 120.

The slide-endwall 168 may include at least one spring-end receptacle 194. The at least one spring-end receptacle 194 is configured to receive the first spring-end 136 of the at least one recoil spring 120. The first spring-end 136 of the recoil spring 120 is configured to engage the spring-end receptacle 194 to couple the recoil spring 120 to the slide-endwall 168 (the front spring guide 114). The first spring-end 136 is biased into coupling engagement with the spring-end receptacle 194 via the recoil spring 120.

Engagement of the first spring-end 136 with the spring-end receptacle 194 holds the recoil spring 120 in place when abutted with and biased against the slide-endwall 168. Engagement of the first spring-end 136 with the spring-end receptacle 194 may maintain the recoil spring 120 in proper position relative to the slide 110 and in proper alignment with the recoil axis 118. For example, engagement of the first spring-end 136 with the spring-end receptacle 194 may prevent linear motion (e.g., in a direction perpendicular to the recoil axis 118) of the first spring-end 136 relative to the slide-endwall 168.

The first spring-end 136 and the spring-end receptacle 194 may be complementary to each other in size and/or shape. For example, each one of the first spring-end 136 and the spring-end receptacle 194 may have any suitable dimension and/or shape such that at least a portion of the first spring-end 136 mates with or fits in the spring-end receptacle 194 in sufficiently close tolerance that the first spring-end 136 and the spring-end receptacle 194 are temporarily joined.

In one or more examples, the spring-end receptacle 194 may depend from (e.g., be formed in) the rear face of the slide-endwall 168. For example, the spring-end receptacle 194 includes, or is formed by, a counterbore formed in the rear face of the slide-endwall 168. However, other configurations of the spring-end receptacle 194 are also contemplated to enable complementary engagement between the first spring-end 136 and the spring-end receptacle 194.

With the slide 110 removed from the receiver 148 and the recoil spring assembly 102 coupled to the slide 110, the first spring-end 136 is in spring-biased engagement with the slide-endwall 168 such that the first spring-end 136 is in complementary engagement with the spring-end receptacle 194. With the firearm 100 in the assembled state and the slide 110 in the fully forward position, the first spring-end 136 is in spring-biased engagement with the slide-endwall 168 such that the first spring-end 136 is in complementary engagement with the spring-end receptacle 194. During recoil (e.g., as the slide 110 travels rearward), the first spring-end 136 remains engaged with the spring-end receptacle 194 and travels rearward with the slide 110.

In the examples illustrated in FIGS. 16 and 17, the rear spring guide 116 includes the spring stop 122 and the at least one spring rod 124. In one or more examples, the spring rod 124 has a length that is less than the full length of the recoil spring 120 when the recoil spring 120 is less than fully compressed (e.g., as illustrated in FIG. 16). In these examples, with the slide 110 in the fully rearward position, the second end of the spring rod 124 is spaced away from the slide-endwall 168. Alternatively, in one or more examples, the spring rod 124 has a length that is approximately equal to the full length of the recoil spring 120 when the recoil spring 120 is less than fully compressed. In these examples, the slide-endwall 168 may include a spring-rod aperture formed within (e.g., bound by) the spring-end receptacle 194 such that, with the slide 110 in the fully rearward position, the second end of the spring rod 124 extends through the spring-rod aperture.

Referring to FIG. 17, by way of examples, the present disclosure is also directed to a method 1000. Implementations of the method 1000 may include a method of making the firearm 100 that includes the recoil spring assembly 102 that is situated above the barrel 108. Implementations of the method 1000 may include a method of operating the firearm 100 that includes the recoil spring assembly 102 that is situated above the barrel 108.

The method 1000 may include a step of (block 1002) retaining the recoil spring assembly 102 within the slide 110 of the firearm 100. In one or more examples, the recoil spring assembly 102 may be coupled to the slide 110 such that the front spring guide 114 is in spring-biased, coupling engagement with the slide 110 and the rear spring guide 116 is in spring-biased, coupling engagement with the slide 110 via the at least one recoil spring 120. In one or more examples, the recoil spring assembly 102 may be coupled to the slide 110 such that the first spring-end 136 is in spring-biased, coupling engagement with the slide-endwall 168 of the slide 110 (the front spring guide 114) and the rear spring guide 116 is in spring-biased, coupling engagement with the slide 110 via the at least one recoil spring 120.

The method 1000 may include a step of (block 1004) coupling the recoil spring assembly 102 to the frame 106 of the firearm 100 and to the slide 110 of the firearm 100 and a step of (block 1006) situating the recoil spring assembly 102 above the barrel 108 of the firearm 100. For example, the slide 110 may be coupled to the frame 106, such as the receiver 148, such that the recoil spring assembly 102 is situated above the barrel 108. In one or more examples, with the slide 110 coupled to the frame 106, the recoil spring assembly 102 may be coupled to the frame 106 and to the slide 110 such that the front spring guide 114 is in spring-biased, coupling engagement with the slide 110 and the rear spring guide 116 is in spring-biased, coupling engagement with the frame 106 via the at least one recoil spring 120. In one or more examples, with the slide 110 coupled to the frame 106, the recoil spring assembly 102 may be coupled to the frame 106 and to the slide 110 such that the first spring-end 136 is in spring-biased, coupling engagement with the slide-endwall 168 of the slide 110 and the rear spring guide 116 is in spring-biased, coupling engagement with the frame 106 via the at least one recoil spring 120.

The method 1000 may include a step of (block 1008) biasing the slide 110 to the fully forward position relative to the frame 106. In one or more examples, with the recoil spring assembly 102 coupled to the frame 106 and to the slide 110, the recoil spring assembly 102 exerts a bias force on the frame 106 and the slide 110 via a bias force exerted on the front spring guide 114, engaged with the slide 110, and the rear spring guide 116, engaged with the frame 106. In one or more examples, with the recoil spring assembly 102 coupled to the frame 106 and to the slide 110, the recoil spring assembly 102 exerts a bias force on the frame 106 and the slide 110 via a bias force exerted on the first spring-end 136, engaged with the slide-endwall 168, and the rear spring guide 116, engaged with the frame 106.

The method 1000 may include a step of (block 1010) transferring a recoil force from the slide 110 to the frame 106 using the recoil spring assembly 102 during the firing cycle of the firearm 100. In one or more examples, with the slide 110 in the fully forward position relative to the frame 106, the recoil spring assembly 102 is less than fully compressed and biases the slide 110 to the fully forward position relative to the frame 106. With the slide 110 in the fully rearward position relative to the frame 106, the recoil spring assembly 102 is fully compressed. Compression of the recoil spring assembly 102 transfers the recoil force from the slide 110 to the frame 106. Decompression of the recoil spring assembly 102 moves the slide 110 from the fully rearward position to the fully forward position. The front spring guide 114 and the rear spring guide 116 move relative to each other along the recoil axis 118 in response to reciprocal motion of the slide 110 relative to the frame 106 during the firing cycle.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "partially" or "at least a portion of" may represent an amount of a whole that includes an amount of the whole that may include the whole. For example, the term "a portion of" may refer to an amount that is greater than 0.01% of, greater than 0.1% of, greater than 1% of, greater than 10% of, greater than 20% of, greater than 30% of, greater than 40% of, greater than 50% of, greater than 60%, greater than 70% of, greater than 80% of, greater than 90% of, greater than 95% of, greater than 99% of, and 100% of the whole.

Although various embodiments of the disclosed firearm, recoil spring assembly, and method have been shown and described, modifications may occur to those skilled in the art upon reading the specification. The present application includes such modifications and is limited only by the scope of the claims.

What is claimed is:

1. A firearm comprising:

a frame;

a barrel coupled to and movable relative to the frame during a firing cycle;

a slide coupled to the frame and movable relative to the frame along a recoil axis, the slide comprising a pair of longitudinal slide-sidewalls and a slide-endwall that extends between the pair of longitudinal slide-sidewalls; and a recoil spring assembly coupled to the frame and to the slide, wherein:

the recoil spring assembly is retained in the slide by a spring force and is situated above the barrel;

the recoil spring assembly engages the slide-endwall of the slide and the frame to bias the slide to a fully forward position relative to the frame; and the recoil spring assembly transfers a recoil force from the slide to the frame.

2. The firearm of claim 1, wherein the recoil spring assembly comprises:

a rear spring guide;

a front spring guide that is movable along the recoil axis relative to the rear spring guide; and at least one recoil spring situated between the front spring guide and the rear spring guide.

3. The firearm of claim 2, wherein:

the front spring guide is coupled to the rear spring guide;

the at least one recoil spring biases the front spring guide into coupling engagement with the slide-endwall of the slide; and the at least one recoil spring biases the rear spring guide into coupling engagement with the frame.

4. The firearm of claim 3, wherein:

the front spring guide comprises at least one front lug;

the slide-endwall of the slide comprises a front-lug receptacle; and the at least one recoil spring biases the front lug into coupling engagement with the front-lug receptacle of the slide-endwall of the slide.

5. The firearm of claim 2, wherein:

the slide-endwall of the slide forms the front spring guide;

the at least one recoil spring comprises a first spring-end that is biased into coupling engagement with the slide-endwall; and the at least one recoil spring biases the rear spring guide into coupling engagement with the frame.

6. The firearm of claim 2, wherein the rear spring guide comprises at least one rear lug biased into coupling engagement with the frame.

7. The firearm of claim 2, wherein:

the rear spring guide is moveable relative to the slide;

with the slide removed from the frame, the at least one recoil spring biases the rear spring guide into coupling engagement with the slide; and the rear spring guide comprises a rear terminus biased into coupling engagement with the slide.

8. The firearm of claim 2, wherein:

one of the front spring guide or the rear spring guide comprises:

a spring stop; and at least one spring rod coupled to the spring stop; and the at least one recoil spring is situated on the at least one spring rod and comprises a first spring-end that abuts the spring stop.

9. The firearm of claim 8, wherein:

another one of the front spring guide or the rear spring guide comprises a spring housing configured to receive at least a portion of the at least one spring rod; and the at least one recoil spring comprises a second spring-end that abuts the spring housing.

10. The firearm of claim 9, wherein the spring housing is configured to receive at least a portion of the at least one recoil spring.

11. A recoil spring assembly for a firearm, the firearm comprising a frame, a slide, and a barrel, and the recoil spring assembly, the recoil spring assembly comprising:

a rear spring guide configured to be situated above the barrel and between a pair of longitudinal slide-sidewalls of the slide;

a front spring guide configured to be situated above the barrel and between the pair of longitudinal slide-sidewalls; and at least one recoil spring situated between the front spring guide and the rear spring guide, wherein:

the front spring guide and the rear spring guide are movable relative to each other along a recoil axis;

the at least one recoil spring is configured to bias the front spring guide and the rear spring guide away from each other;

with the firearm in a partially assembled state in which the slide is uncoupled from the frame and the barrel, the recoil spring assembly is configured to be retained in the slide by a spring force;

with the firearm in an assembled state, the recoil spring assembly is configured to engage a slide-endwall of the slide that extends between the pair of longitudinal slide-sidewalls and the frame to bias the slide to a fully forward position relative to the frame; and the recoil spring assembly is configured to transfer a recoil force from the slide to the frame.

12. The recoil spring assembly of claim 11, wherein:

the front spring guide is coupled to the rear spring guide;

the at least one recoil spring is configured to bias the front spring guide into coupling engagement with the slide-endwall of the slide;

with the firearm in the assembled state, the at least one recoil spring is configured to bias the rear spring guide into coupling engagement with the frame; and with the firearm in the partially assembled state, the at least one recoil spring is configured to bias the rear spring guide into coupling engagement with the slide.

13. The recoil spring assembly of claim 12, wherein:

the front spring guide comprises at least one front lug;

the at least one recoil spring is configured to bias the at least one front lug into coupling engagement with a front-lug receptacle formed in the slide-endwall of the slide.

14. The recoil spring assembly of claim 11, wherein:

the front spring guide is formed by the slide-endwall of the slide;

the at least one recoil spring comprises a first spring-end that is configured to be biased into coupling engagement with the slide-endwall; and the at least one recoil spring is configured to bias the rear spring guide into coupling engagement with the frame.

15. The recoil spring assembly of claim 11, wherein the rear spring guide comprises at least one rear lug configured to be coupled to the frame when the firearm is in the assembled state.

16. The recoil spring assembly of claim 11, wherein:

the rear spring guide comprises a rear terminus configured to be coupled to the slide when the firearm is in the partially assembled state; and the at least one recoil spring is configured to bias the rear terminus of the rear spring guide into coupling engagement with the slide.

17. The recoil spring assembly of claim 11, wherein:

one of the front spring guide or the rear spring guide comprises:

a spring stop; and at least one spring rod coupled to the spring stop; and the at least one recoil spring is situated on the at least one spring rod.

18. The recoil spring assembly of claim 17, wherein another one of the front spring guide or the rear spring guide comprises a spring housing configured to receive at least a portion of the at least one spring rod.

19. The recoil spring assembly of claim 18, wherein the at least one recoil spring comprises:

a first spring-end that abuts the spring stop; and a second spring-end that abuts the spring housing.

20. A method comprising:

retaining a recoil spring assembly in a slide of a firearm by a spring force;

coupling the slide to a barrel of the firearm such that:

the recoil spring assembly is situated above the barrel and between a pair of longitudinal slide-sidewalls of a slide of the firearm; and the recoil spring assembly engages a frame of the firearm and a slide-endwall of the slide that extends between the pair of longitudinal slide-sidewalls; and biasing the slide to a fully forward position relative to the frame using the recoil spring assembly, wherein the recoil spring assembly is configured to transfer a recoil force from the slide to the frame.

* * * * *